US008814321B2

(12) United States Patent
Shimizu et al.

(10) Patent No.: US 8,814,321 B2
(45) Date of Patent: Aug. 26, 2014

(54) LIQUID EJECTION APPARATUS

(71) Applicant: Brother Kogyo Kabushiki Kaisha, Nagoya (JP)

(72) Inventors: Yoichiro Shimizu, Kasugai (JP); Kenji Matoba, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,558

(22) Filed: Mar. 28, 2013

(65) Prior Publication Data

US 2013/0278653 A1 Oct. 24, 2013

(30) Foreign Application Priority Data

Apr. 20, 2012 (JP) ..... 2012-096304

(51) Int. Cl.
*B41J 2/165* (2006.01)

(52) U.S. Cl.
USPC ..... 347/29

(58) Field of Classification Search
USPC ..... 347/29, 30, 20, 22, 25
See application file for complete search history.

(56) References Cited

U.S. PATENT DOCUMENTS

| | | | | |
|---|---|---|---|---|
| 7,401,888 | B2 * | 7/2008 | Karppinen et al. | 347/25 |
| 8,075,112 | B2 * | 12/2011 | Silverbrook | 347/85 |
| 2012/0194606 | A1 | 8/2012 | Shinoda | |

FOREIGN PATENT DOCUMENTS

| | | | |
|---|---|---|---|
| JP | H03-184852 | A | 8/1991 |
| JP | 2003-334962 | A | 11/2003 |
| JP | 2004-122543 | A | 4/2004 |
| JP | 2006-062166 | A | 3/2006 |
| JP | 2012-158070 | A | 8/2012 |

* cited by examiner

*Primary Examiner* — Lamson Nguyen
(74) *Attorney, Agent, or Firm* — Merchant & Gould PC

(57) ABSTRACT

A liquid ejection apparatus includes: a head having an ejection face; a humid-air supplier including a storage portion for storing humidification liquid containing water and a non-volatile component and configured to perform a humidifying operation in which humid air humidified by the humidification liquid is supplied into a space near the ejection face; and an indicator obtainer configured to obtain an indicator indicating a concentration of the non-volatile component in the humidification liquid in the storage portion. The humidifying operation is performed after the ejection space is switched to the sealed state. An amount of the humid air and/or an amount of water of the humid air to be supplied in the humidifying operation is increased with increase in the concentration indicated by the indicator.

17 Claims, 15 Drawing Sheets

LIQUID EJECTION APPARATUS

CROSS REFERENCE TO RELATED APPLICATION

The present application claims priority from Japanese Patent Application No. 2012-096304, which was filed on Apr. 20, 2012, the disclosure of which is herein incorporated by reference in its entirety.

BACKGROUND OF THE INVENTION

1. Field of the Invention

The present invention relates to a liquid ejection apparatus configured to eject liquid.

2. Description of the Related Art

To prevent increase in viscosity of ink in nozzles of an ink-jet head, there is known a technique of establishing communication between an inside of a cap for air-tightly capping an ejection face having the nozzles and a water tank as a storage portion for storing water or humidification liquid. In this technique, air humidified by water in the water tank is supplied to the inside of the cap.

SUMMARY OF THE INVENTION

In the above-described technique, in a case where the water in the water tank contains a non-volatile component (e.g., a component of a preservative), only a water component vaporizes with passage of humidification time, resulting in a larger ratio of an amount of the non-volatile component in the water tank. The increase in a concentration of the non-volatile component in the water tank decreases performance of humidification for humidifying the inside of the cap by the humidified air. As a result, the ink near the nozzles easily dries, resulting in a need to discharge a larger amount of ink from the nozzles to recover from this dried state of the ink. The decrease in the humidification performance may be caused also in a configuration for performing the humidification without capping.

This invention has been developed to provide a liquid ejection apparatus capable of suppressing drying of liquid near an ejection opening.

The present invention provides a liquid ejection apparatus, including: a head having an ejection face that has an ejection opening through which liquid is ejected by the head; a humid-air supplier includes a storage portion for storing humidification liquid including water and a non-volatile component, the humid-air supplier being configured to perform a humidifying operation in which humid air humidified by the humidification liquid is supplied into a space located in a vicinity of the ejection face; an indicator obtainer configured to obtain an indicator indicating a concentration of the non-volatile component in the humidification liquid stored in the storage portion; and a controller configured to control the humid-air supplier, the controller being configured to control the humid-air supplier to at least one of increase a humid-air supply amount in the humidifying operation with an increase in the concentration indicated by the indicator obtained by the indicator obtainer; and increase an amount of water of the humid air to be supplied into the space located in the vicinity of the ejection face in the humidifying operation with the increase in the concentration indicated by the indicator obtained by the indicator obtainer, wherein the humid-air supply amount is an amount of the humid air to be supplied into the space located in the vicinity of the ejection face.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which.

DETAILED DESCRIPTION OF THE EMBODIMENT

Figure 1:
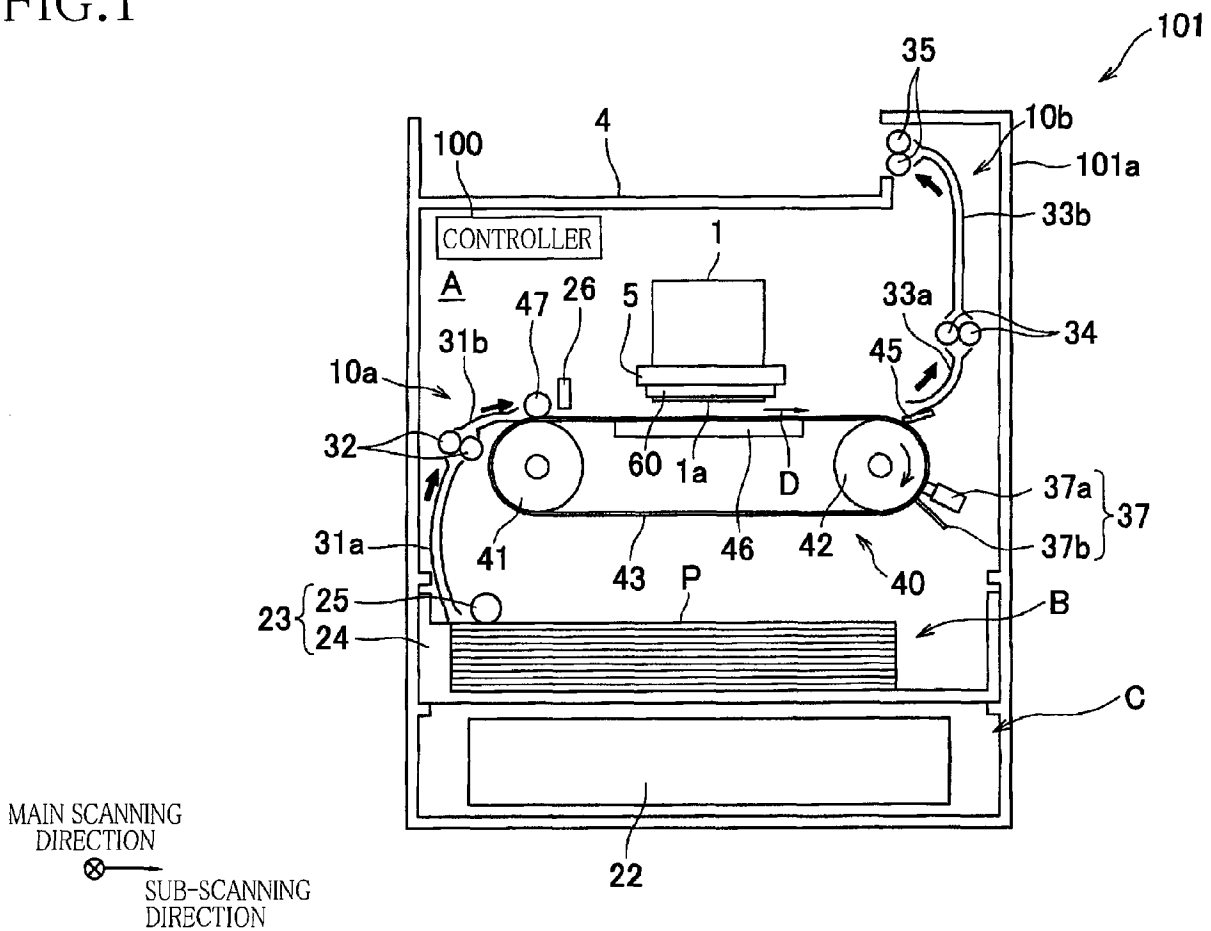
FIG. 1 is a side view generally illustrating an internal structure of an ink-jet printer as one example of a liquid ejection apparatus according to one embodiment of the present invention is applied.

Hereinafter, there will be described one embodiment of the present invention by reference to the drawings.

First, there will be explained an overall construction of an ink jet printer 101 as one example of a liquid ejection apparatus according to one embodiment of the present invention.

The printer 101 includes a housing 101*a* having a rectangular parallelepiped shape. A sheet-output portion 4 is provided on a top plate of the housing 101*a*. An inner space of the housing 101*a* is divided into spaces A, B, and C in order from an upper side thereof. Formed in the spaces A and B is a sheet conveyance path extending from a sheet-supply portion 23 to the sheet-output portion 4. A recording medium in the form of a sheet P is conveyed through the sheet conveyance path along bold arrows indicated in FIG. 1. In the space A, an image is formed or recorded on the sheet P, and the sheet P is conveyed to the sheet-output portion 4. In the space B, the sheet P is supplied to the conveyance path. In the space C, ink is supplied to a head 1 provided in the space A.

Components arranged in the space A include: a head 1 configured to eject black ink; a conveyor mechanism 40; two guide portions 10*a*, 10*b* for guiding the sheet P; a sheet sensor 26; a humidity sensor 29 (see FIG. 8) as one example of a detector portion; a humid-air supply mechanism 50 (see FIG. 6) used in a humidifying operation; a cleaner unit 37; a buzzer 27 (see FIG. 8); and a controller 100. It is noted that the humidity sensor 29 is disposed near the head 1 to detect humidity of ambient air of the head 1.

The head 1 is supported by the housing 101*a* via a head holder 5. A lower face of the head 1 is an ejection face 1*a* having a multiplicity of ejection openings 108 (see FIG. 3). The head holder 5 holds and supports the head 1 so as to form a predetermined space suitable for the recording, between the ejection face 1*a* and a conveyor belt 43.

The head 1 is a stacked body including: a head main body 3 (see FIG. 2); a reservoir unit; a flexible printed circuit (FPC); and a circuit board which are stacked on one another. Signals adjusted by the circuit board are converted by a driver IC on the FPC to drive signals. These drive signals are output to actuator units 21. When the actuator units 21 are activated, the ink supplied from the reservoir unit is ejected from the ejection openings 108.

A cap 60 of the humid-air supply mechanism 50 is mounted on the head holder 5. The cap 60 is provided on the head 1 so as to enclose the head 1 in plan view. A structure, an operation, a function, and so on of the cap 60 will be explained later in detail.

The conveyor mechanism 40 includes: two belt rollers 41, 42; the conveyor belt 43; a platen 46; a nip roller 47; and a peeling plate 45. The conveyor belt 43 is an endless belt looped over the rollers 41, 42. The platen 46 is disposed opposite the head 1 so as to support an upper loop of the conveyor belt 43 from an inside thereof. The belt roller 42 is a drive roller that rotates the conveyor belt 43. The belt roller 42 is rotated in a clockwise direction in FIG. 1 by a motor, not shown. The belt roller 41 is a driven roller that is rotated by the rotation of the conveyor belt 43. The nip roller 47 presses the sheet P supplied from the sheet-supply portion 23, onto an outer circumferential face of the conveyor belt 43. The sheet P is conveyed toward the head 1 while held by a silicon layer of the conveyor belt 43 which is a layer having a low viscosity and covering the outer circumferential face of the conveyor belt 43. The peeling plate 45 peels the conveyed sheet P off from the conveyor belt 43 and guides the sheet P toward the sheet-output portion 4.

The two guide portions 10*a*, 10*b* are disposed so as to interpose the conveyor mechanism 40 therebetween. The upstream guide portion 10*a* in the conveying direction includes two guides 31*a*, 31*b* and a conveyor roller pair 32 and connects between the sheet-supply portion 23 and the conveyor mechanism 40. The sheet P for image recording is conveyed toward the conveyor mechanism 40. The downstream guide portion 10*b* in the conveying direction includes two guides 33*a*, 33*b* and two conveyor roller pairs 34, 35 and connects between the conveyor mechanism 40 and the sheet-output portion 4. The sheet P with an image recorded thereon is conveyed toward the sheet-output portion 4.

The sheet sensor 26 is disposed upstream of the head 1 to sense a leading edge of the conveyed sheet P. A sense signal output upon this sensing is used for synchronization of driving timings of the head 1 and the conveyor mechanism 40, whereby an image is formed at desired resolution and speed.

Figure 8:
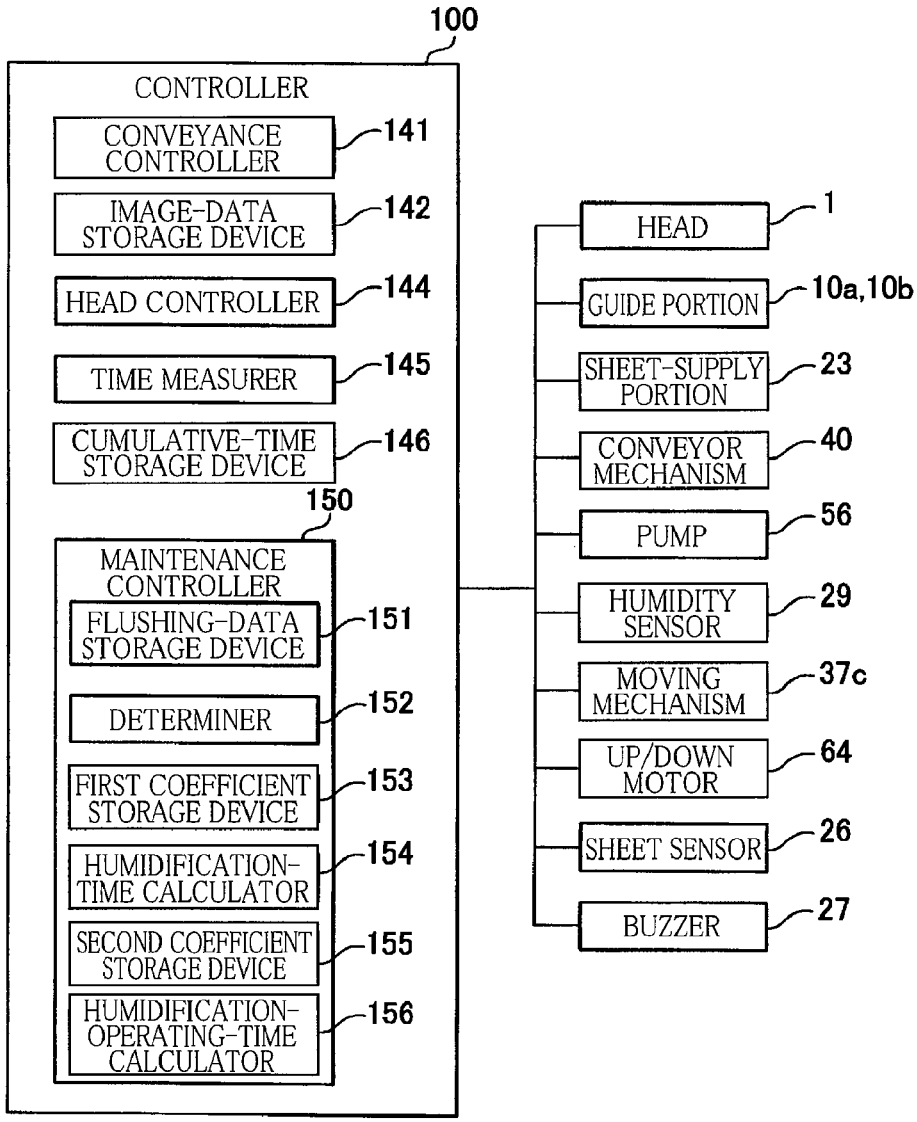
FIG. 8 is a block diagram illustrating a configuration of a controller in FIG. 1.

The cleaner unit 37 includes a cleaning-liquid application member 37*a*, a blade 37*b*, and a moving mechanism 37*c* (see FIG. 8). The cleaner unit 37 is for cleaning the outer circumferential face of the conveyor belt 43. As illustrated in FIG. 1, the cleaner unit 37 is disposed opposite the belt roller 42 and on a right and lower side of the conveyor belt 43. The cleaning-liquid application member 37*a* is constituted by a porous body (e.g., a sponge) and a support member for supporting this porous body. The blade 37*b* is a plate-like elastic member formed of a rubber, for example. Both of the cleaning-liquid application member 37*a* and the blade 37*b* are contactable with an entire width of the conveyor belt 43. The moving mechanism 37*c* moves the cleaning-liquid application member 37*a* and the blade 37*b* to or away from the outer circumferential face of the conveyor belt 43. In a cleaning operation, while the conveyor belt 43 is rotated in a state in which the cleaning-liquid application member 37*a* and the blade 37*b* are held in contact with the outer circumferential face of the conveyor belt 43, cleaning liquid is applied from the porous body to the outer circumferential face, and then the blade 37*b* located downstream of the porous body wipes soils and the cleaning liquid off the outer circumferential face.

The sheet-supply portion 23 is disposed in the space B. The sheet-supply portion 23 includes a sheet-supply tray 24 and a sheet-supply roller 25. The sheet-supply tray 24 is mountable on and removable from the housing 101*a*. The sheet-supply tray 24 has a box shape opening upward and can accommodate a plurality of the sheets P. The sheet-supply roller 25 is rotated under a control of the controller 100 to supply an uppermost one of the sheets P accommodated in the sheet-supply tray 24.

Here, a sub-scanning direction is a direction parallel to the conveying direction D in which the sheet is conveyed by the conveyor mechanism 40, and the main scanning direction is a direction parallel to a horizontal plane and perpendicular to the sub-scanning direction.

A cartridge 22 for storing the black ink is disposed in the space C so as to be mountable on and removable from the housing 101*a*. The cartridge 22 is coupled to the head 1 via a tube (not shown) and a pump (not shown). It is noted that the pump is driven in forcible delivery of the ink to the head 1 (e.g., an initial supply of the ink) and stopped in the other situations so as not to inhibit the ink supply to the head 1.

There will be next explained the controller 100. The controller 100 controls the components of the printer 101 to control the operations of the printer 101. The controller 100 controls an image recording operation on the basis of a print signal supplied from an external device such as a personal computer (PC) coupled to the printer 101. Specifically, the controller 100 controls operations such as the conveyance operation of the sheet P and the ink ejecting operation synchronized with the conveyance of the sheet P.

On the basis of the print signal received from the external device, the controller 100 drives the sheet-supply portion 23, the conveyor mechanism 40, and the conveyor roller pairs 32, 34, 35. The sheet P supplied from the sheet-supply tray 24 is conveyed to the conveyor mechanism 40 while guided by the upstream guide portion 10*a*. When the sheet P conveyed by the conveyor mechanism 40 passes through a position just under the head 1, the head 1 ejects the ink onto the sheet P. As a result, a desired image is formed on the sheet P. The sheet P with the image formed thereon is peeled off from the conveyor belt 43 by the peeling plate 45 and then discharged onto the sheet-output portion 4 from an upper portion of the housing 101*a* while guided by the downstream guide portion 10*b*.

The controller 100 also controls a maintenance operation. In this maintenance operation, ink ejection characteristics of the head 1 are recovered or maintained, and the printing is prepared. The maintenance operation includes: a flushing operation; the cleaning operation for cleaning the conveyor belt 43; and an operation for preventing increase in ink viscosity such as capping and humidification.

In the flushing operation, the actuator units 21 are driven to eject the ink from the ejection openings 108. This ink ejection is performed based on flushing data that differs from image data based on which the image recording is performed. In the cleaning operation, the conveyor belt 43 is wiped by the cleaner unit 37. The cleaning operation is performed after the flushing operation, whereby foreign matters such as residual ink are removed from the conveyor belt 43.

Figure 6:
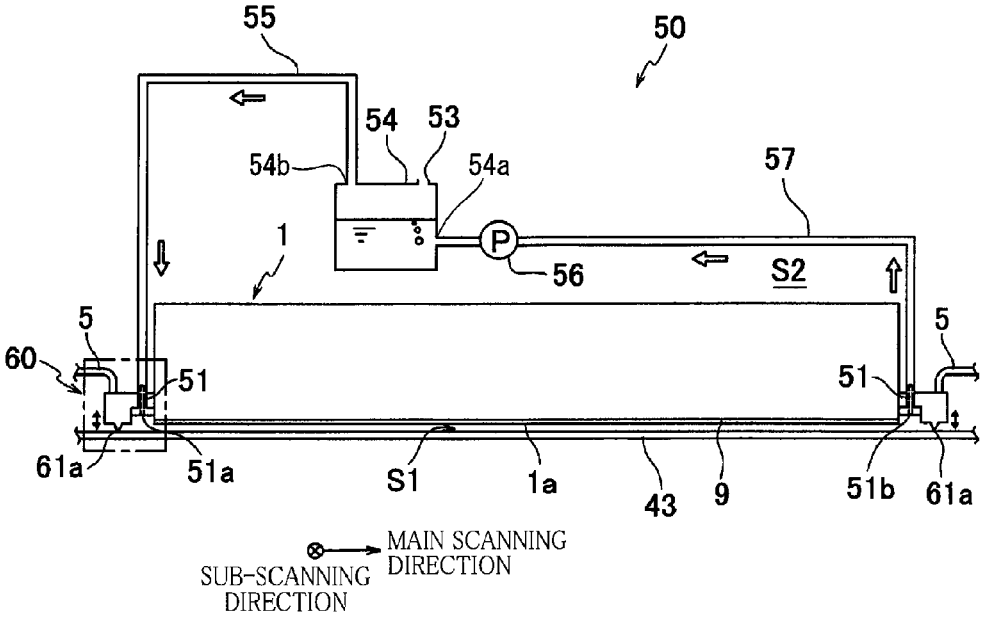
FIG. 6 is a schematic view illustrating a head holder and a humid-air supply mechanism included in the printer in FIG. 1.

In the capping, as illustrated in FIG. 6, an ejection space S1 that faces or is opposed to the ejection face 1*a* is substantially isolated from an outside space S2 by the cap 60 to suppress drying of ink meniscuses. In the humidifying operation, humid air is supplied into the isolated ejection space S1. As a result, water vapors accumulate in the ejection space S1, thereby further suppressing the drying of the ink meniscuses.

Figure 2:
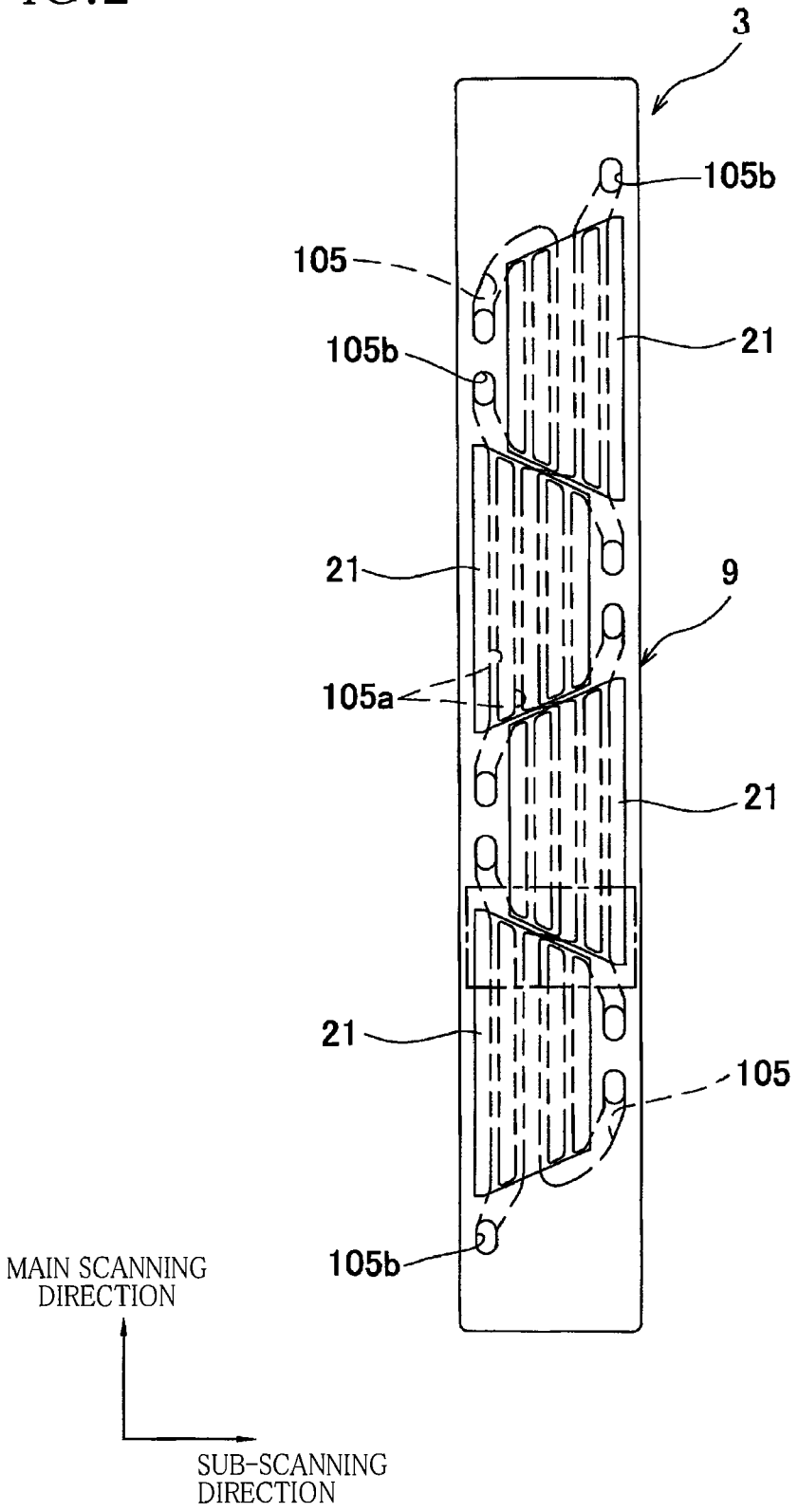
FIG. 2 is a plan view illustrating a head main body of a head included in the printer in FIG. 1.
Figure 3:
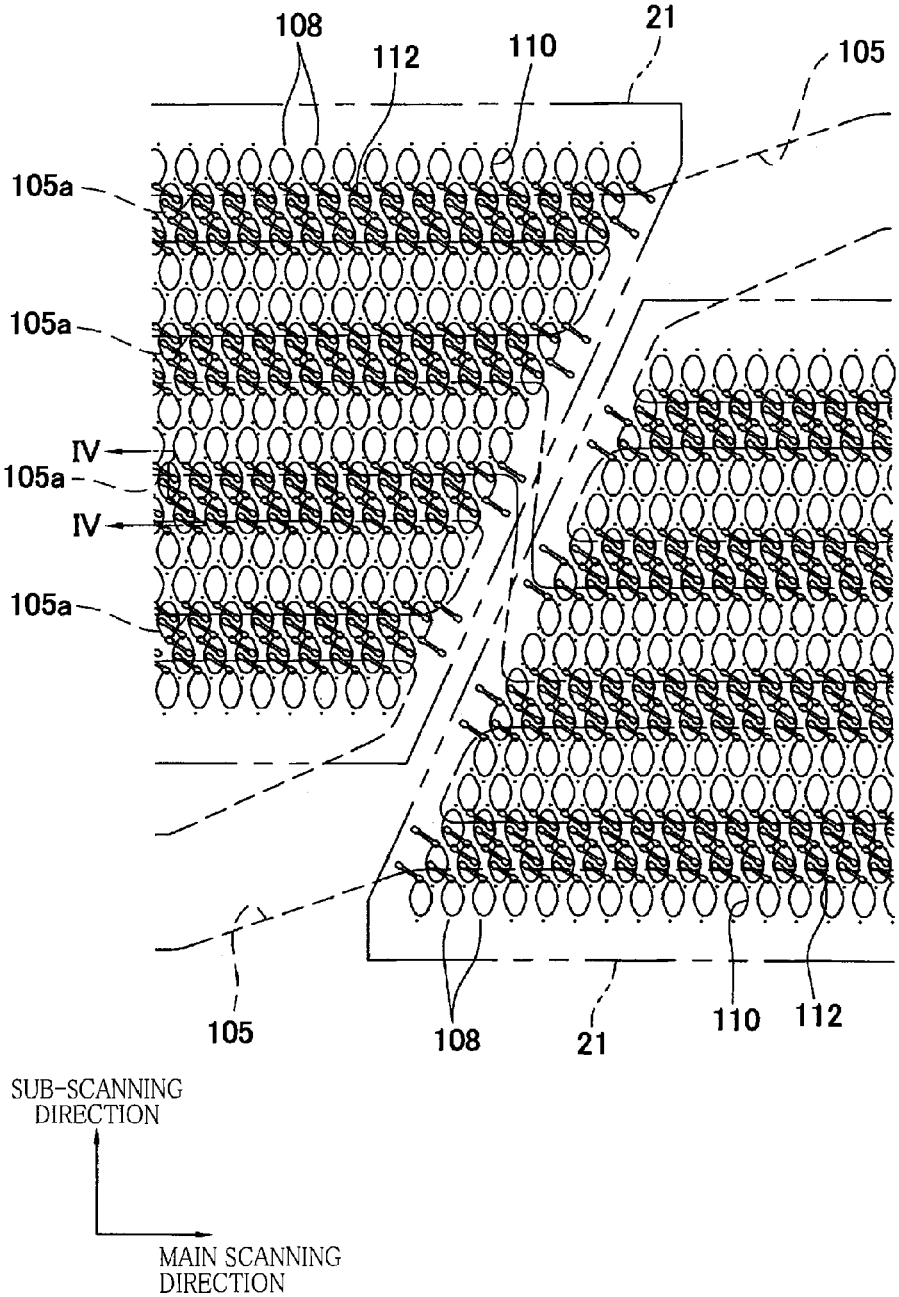
FIG. 3 is an enlarged view illustrating an area enclosed by one-dot chain line in FIG. 2.

There will be next explained the head 1 with reference to FIGS. 2-5. In FIG. 3, pressure chambers 110, apertures 112, and the ejection openings 108 are illustrated by solid lines for easier understanding purposes though these elements are located under the actuator units 21 and thus should be illustrated by broken lines.

Figure 4:
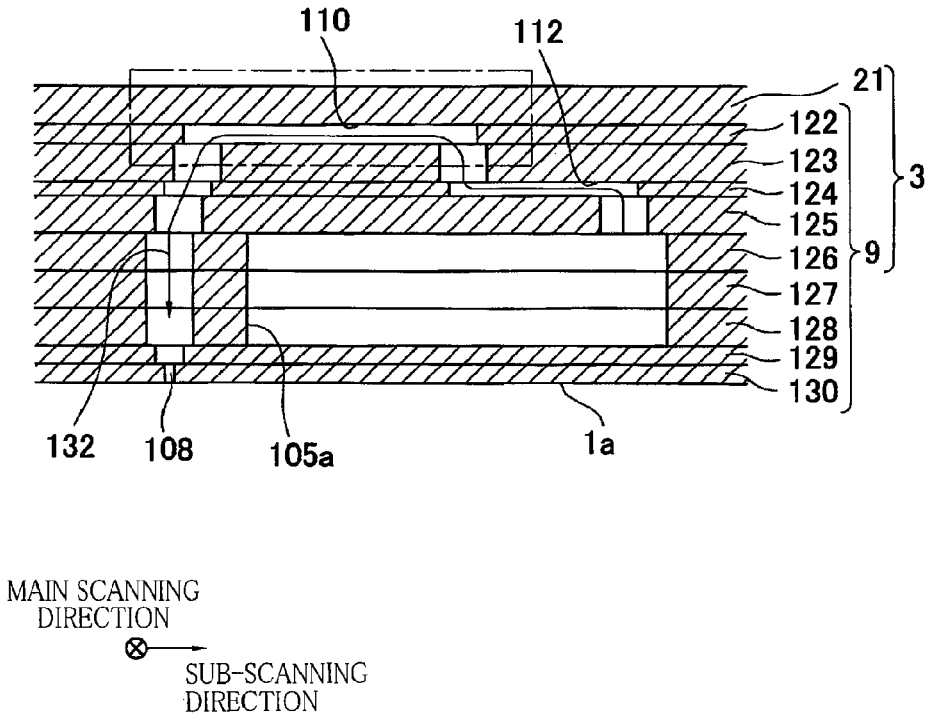
FIG. 4 is a partial cross-sectional view taken along line IV-IV in FIG. 3.

As illustrated in FIG. 4, the channel unit 9 is a stacked body constituted by nine metal plates 122-130 formed of stainless steel stacked on one another. As illustrated in FIG. 2, an upper face of the channel unit 9 has ten ink supply openings 105*b* opening therein. As illustrated in FIGS. 2-4, manifold channels 105 and sub-manifold channels 105*a* are formed in the channel unit 9. Each of the ink supply openings 105*b* is formed at one end of a corresponding one of the manifold channels 105, and each of the sub-manifold channels 105*a* is branched off from a corresponding one of the manifold channels 105. Also, formed in the channel unit 9 are individual ink channels 132 each extending from an outlet of a corresponding one of the sub-manifold channels 105*a* to a corresponding one of the ejection openings 108 via a corresponding one of the apertures 112 and a corresponding one of the pressure chambers 110. A lower face of the channel unit 9 is the ejection face 1*a* in which the ejection openings 108 are arranged in matrix. In each row, these ejection openings 108 are arranged at predetermined pitches in the main scanning direction.

The reservoir unit is a channel member in which ink channels are formed like the channel unit 9. The ink to be supplied to the channel unit 9 is stored in a reservoir of the ink channels. As illustrated in FIGS. 2-4, the ink in the reservoir unit is supplied from the ink supply openings 105*b* to the channel unit 9. It is noted that the pump forcibly supplies the ink into the channel unit 9 via the reservoir unit.

There will be next explained the actuator units 21. The actuator units 21 are fixed to the upper face of the channel unit 9 and partly constitute the head main body 3. As illustrated in FIG. 2, each of the four actuator units 21 has a trapezoid shape in plan view, and the four actuator units 21 are arranged in a staggered configuration in the main scanning direction so as not to overlap the ink supply openings 105*b*.

Figure 5:
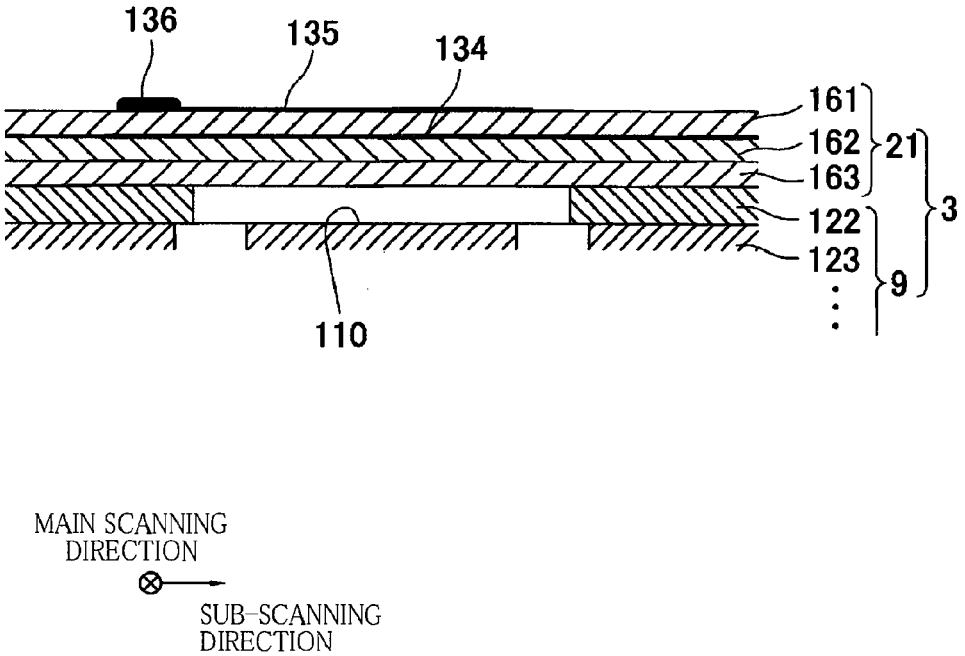
FIG. 5 is an enlarged view illustrating an area enclosed by one-dot chain line in FIG. 4.

Each of the actuator units 21 is a piezoelectric actuator constituted by three piezoelectric layers 161-163 each formed of a ceramic material of lead zirconate titanate (PZT) having ferroelectricity. The uppermost piezoelectric sheet 161 is polarized in a thickness direction thereof and sandwiched between (a) individual electrodes 135 disposed on an upper face of the piezoelectric sheet 161 and (b) a common electrode 134 expanding across a lower face of the piezoelectric sheet 161. As illustrated in FIG. 5, the most part of each individual electrode 135 is opposite the corresponding pressure chamber 110, and a part of the individual electrode 135 not overlapping the pressure chamber 110 in plan view is connected to a corresponding one of individual lands 136. This design is formed for each pressure chamber 110. Portions of the piezoelectric layers 161-163 which are sandwiched between the individual electrode 135 and the pressure chamber 110 act as an individual actuator which is one example of an energy applier and a liquid discharger. That is, the actuator units 21 include the actuators respectively corresponding to the pressure chambers 110, and each actuator selectively applies ejection energy to the ink in the corresponding pressure chamber 110.

Here, there will be explained a method for driving each actuator unit 21. Each actuator is what is called a unimorph actuator. When an electric field in the polarization direction is applied to each portion of the piezoelectric layer 161 which is sandwiched between the common electrode 134 and the corresponding individual electrode 135, the portion is contracted in a direction perpendicular to the polarization direction (i.e., in a planar direction). This contraction contracts the portions of the piezoelectric layers 162, 163 just under the contracted portion of the piezoelectric layer 161, but an amount of the contraction of the portion of the piezoelectric layer 162 and that of the portion of the piezoelectric layer 163 are different from each other. Thus, the portions of the piezoelectric layers 161-163 which are sandwiched between the individual electrode 135 and the pressure chamber 110 project toward the pressure chamber 110. This deformation applies a pressure (i.e., the ejection energy) to the ink in the pressure chamber 110, causing an ink droplet to be ejected from the ejection opening 108.

It is noted that, in the present embodiment, a drive signal is supplied to the individual electrode 135 maintained at a predetermined electric potential, and thereby the electric potential of the individual electrode 135 temporarily becomes a ground potential and then returns to the predetermined electric potential at a predetermined timing. This ejection method is what is called a "fill-before-fire" method. When the electric potential temporarily becomes the ground potential, a volume of the pressure chamber 110 increases, causing the ink to be sucked into the pressure chamber 110. When the electric potential returns to the predetermined electric potential, the volume of the pressure chamber 110 is reduced (that is an ink pressure increases), and thereby the ink droplet is ejected from the ejection opening 108.

Figure 7:
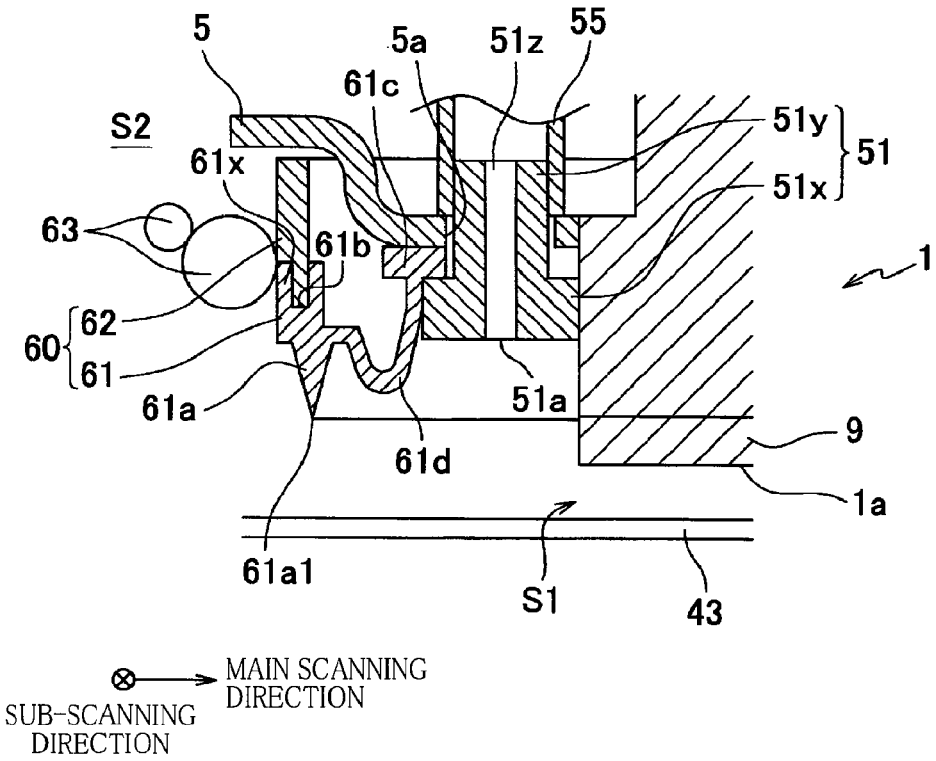
FIG. 7 is a partial cross-sectional view illustrating an area enclosed by one-dot chain line in FIG. 6 and illustrating a situation in which a cap located at a distant position.

There will be next explained a capping mechanism mounted on the head holder 5 with reference to FIGS. 6 and 7.

The head holder 5 is a frame formed of a metal, for example, and supporting side faces of the head 1 in their entire perimeters. The head holder 5 is a support member for the head 1 and is also a member of the capping mechanism. The cap 60 is mounted on the head holder 5. Here, a contact portion of the head holder 5 and the head 1 is sealed by a sealant in their entire perimeters. Further, a contact portion of the head holder 5 and the cap 60 is fixed by an adhesive in their entire perimeters.

The capping mechanism includes: the head holder 5; the cap 60; an up/down power transmission mechanism; and the conveyor belt 43. The up/down power transmission mechanism causes the cap 60 to be brought into contact with or moved off the conveyor belt 43, whereby the ejection space S1 opposed to the ejection face 1*a* takes an unsealed state or a sealed state. The up/down power transmission mechanism includes an up/down motor 64 (see FIG. 8) and a plurality of gears 63. The cap 60 is a rectangular member that encloses entire outer faces of the head 1 in plan view. As illustrated in FIG. 7, the cap 60 is constituted by an elastic member 61 and a movable member 62.

The elastic member 61 is formed of an elastic material such as rubber and encloses the outer faces of the head 1 in plan view. As illustrated in FIG. 7, the elastic member 61 includes:

a base portion 61$x$; a projecting portion 61$a$ projecting from a lower face of the base portion 61$x$; a fixed portion 61$c$ fixed to the head holder 5; and a connecting portion 61$d$ connecting between the base portion 61$x$ and the fixed portion 61$c$. The projecting portion 61$a$ has a triangle shape in its cross section. In other words, the projecting portion 61$a$ is tapered toward its lower end. The fixed portion 61$c$ has a T-shape in its cross section. A flat upper end portion of the fixed portion 61$c$ is fixed to the head holder 5 by an adhesive or the like. The fixed portion 61$c$ is supported by and between the head holder 5 and a basal end portion 51$x$ of each of joints 51 which will be described below. The connecting portion 61$d$ curves from a lower end of the fixed portion 61$c$ so as to extend toward an outside (i.e., in a direction away from the ejection face 1$a$ in plan view) and finally is connected to a side face of a lower portion of the base portion 61$x$. The connecting portion 61$d$ is deformed when the movable member 62 is moved upward or downward. A recessed portion 61$b$ is formed in an upper face of the base portion 61$x$. A lower end of the movable member 62 is fitted in this recessed portion 61$b$.

The movable member 62 is formed of a rigid material such as stainless steel and encloses the outer faces of the head 1 in plan view. The movable member 62 is supported by the base portion 61$x$ so as to be movable relative to the head holder 5 in a vertical direction. The movable member 62 is connected to the up/down motor 64 via the gears 63. When the up/down motor 64 is driven by the control of the controller 100, the gears 63 are rotated, which moves the movable member 62 upward or downward. As a result, a position of a distal end 61$a$1 of the projecting portion 61$a$ relative to the ejection face 1$a$ is changed in the vertical direction.

The projecting portion 61$a$ is selectively positioned at a contact position indicated in FIG. 6 at which the distal end 61$a$1 is held in contact with the outer circumferential face of the conveyor belt 43 or at a distant position indicated in FIG. 7 at which the distal end 61$a$1 is distant from the outer circumferential face. At the contact position, the ejection space S1 is in the sealed state in which the ejection space S1 is substantially isolated from the outside space S2. At the distant position, the ejection space S1 is in the unsealed state in which the ejection space S1 communicates with and opens to the outside space S2.

There will be next explained a structure of the humid-air supply mechanism 50 with reference to FIG. 6. As illustrated in FIG. 6, the humid-air supply mechanism 50 as one example of a humid-air supplier includes: the cap 60 of the capping mechanism; a pair of the joints 51; tubes 55, 57; a pump 56; and a tank 54. The cap 60 is for establishing the sealed state of the ejection space S1, and each joint 51 is for replacing an air in the space S1 with humid air.

The pair of joints 51 respectively function as an inlet and an outlet through which the humid air is supplied into and discharged from the ejection space S1. As illustrated in FIG. 6, the pair of joints 51 are constituted by a left joint 51 having a supply opening 51$a$ as one example of a first opening and a right joint 51 having a discharge opening 51$b$ as one example of a second opening. The pair of joints 51 are disposed so as to interpose the head 1 therebetween in the main scanning direction. In the humidifying operation, the humid air is supplied into the ejection space S1 from the supply opening 51$a$, and the air in the ejection space S1 is discharged from the discharge opening 51$b$.

Each joint 51 is constituted by the basal end portion 51$x$ having a square shape in plan view and a distal end portion 51$y$ having a circular cylindrical shape. In the joint 51, a hollow space 51$z$ (see FIG. 7) is formed through the basal end portion 51$x$ and the distal end portion 51$y$ in the vertical direction. The hollow space 51$z$ has a circular cylindrical shape in the distal end portion 51$y$ and has a fan shape in the basal end portion 51$x$. This fan shaped space communicates with the circular cylindrical space and is widened so as to be connected to the supply opening 51$a$. The supply opening 51$a$ is elongated in the sub-scanning direction, and its length is generally equal to that of the ejection face 1$a$ in the sub-scanning direction. It is noted that an outer size of the basal end portion 51$x$ is greater than that of the distal end portion 51$y$.

As illustrated in FIG. 7, each joint 51 is fixed to a corresponding one of through holes 5$a$ of the head holder 5. Specifically, the distal end portion 51$y$ is fitted in the through hole 5$a$, and a space therebetween is filled with a sealant.

Each of the tubes 55, 57 is coupled to the tank 54 and a corresponding one of the joints 51 to establish communication between the tank 54 and the ejection space S1. Specifically, the tube 55 as one example of a first air passage is connected to an air outlet 54$b$ of the tank 54, and the tube 57 as one example of a second air passage is connected to an air inlet 54$a$ of the tank 54. Here, when the ejection space S1 is in the sealed state, the pump 56 can circulate the humid air.

The tank 54 as one example of a storage portion stores humidification liquid in its lower space and stores humid air in its upper space. The humidification liquid contains water (i.e., a water component), a non-volatile component of, e.g., a preservative, and other similar components. An upper wall of the tank 54 has an air communicating opening 53 for establishing communication between the upper space of the tank 54 and an ambient air. Here, the tube 57 communicates with the lower space of the tank 54 (beneath a humidification liquid surface), and the tube 55 communicates with the upper space of the tank 54. It is noted that, when an amount of the humidification liquid in the tank 54 becomes small, the humidification liquid in the tank 54 is replaced with new humidification liquid by a user.

As illustrated in FIG. 6, the pump 56 is provided on the tube 57 near the tank 54. While driving of the pump 56, air is transferred in one direction. This one direction is a direction directed from the pump 56 toward the tank 54. A check valve, not shown, is provided between the pump 56 and the tank 54 for inhibiting the water in the tank 54 from flowing into the pump 56.

In this construction, when the humidifying operation is started, the controller 100 drives the pump 56 to circulate the air in the tank 54 along white arrows as illustrated in FIG. 6. The humid air in the upper space of the tank 54 is supplied into the ejection space S1 through the supply opening 51$a$. Since the ejection space S1 is in the sealed state in this supply, the air in the ejection space S1 flows toward the discharge opening 51$b$ while replaced with the humid air. Since the tube 57 communicates with the tank 54 underwater, the air having flowed from the ejection space S1 is humidified in the tank 54. The produced humid air is supplied into the ejection space S1 during the driving of the pump 56.

There will be next explained the controller 100 with reference to FIG. 8. The controller 100 includes: a central processing unit (CPU); a read only memory (ROM) rewritably storing programs executable by the CPU and data used for these programs; and a random access memory (RAM) temporarily storing data in the execution of the programs. The controller 100 includes various functional portions which are constituted by cooperation of these hardware and software in the ROM with each other. As illustrated in FIG. 8, the controller 100 includes a conveyance controller 141, an image-data storage device 142, a head controller 144, a time measurer 145, a cumulative-time storage device 146, and a maintenance controller 150.

The conveyance controller 141 controls the sheet-supply portion 23, the guide portions 10*a*, 10*b*, and the conveyor mechanism 40 on the basis of the print signal received from the external device such that the sheet P is conveyed at a predetermined speed in the conveying direction. The image-data storage device 142 stores image data contained in the print signal received from the external device. The head controller 144 controls the head 1 to perform the image recording, i.e., printing, on the sheet P based on the image data and the flushing operation based on the flushing data. Based on the signal output from the sheet sensor 26, the head controller 144 controls the actuator in accordance with the conveyance of the sheet P.

The time measurer 145 measures a length of time elapsed from a completion of the printing based on the image data. The cumulative-time storage device 146 as one example of an indicator obtainer stores a cumulative time (i.e., a cumulative total time) that is a cumulative total of humidification operating times of respective humidifying operations previously performed. It is noted that the cumulative-time storage device 146 resets the stored cumulative time when a user presses a reset button, not shown, after replacing the humidification liquid in the tank 54 with new one.

In the present embodiment, the humidifying operation is performed such that the humid air is supplied into the ejection space S1 at a uniform velocity or speed (i.e., a uniform flow velocity). In the humidification liquid stored in the tank 54, the water is consumed with passage of the humidification operating time (as one example of a humid-air supply time), so that a concentration of the non-volatile component in the humidification liquid increases or rises. The present embodiment employs the cumulative total of the humidification operating times (i.e., the cumulative time) as an indicator indicating the concentration of the non-volatile component in the humidification liquid. Since an amount of humid air to be supplied into the ejection space S1 per unit time (as one example of a humid-air supply amount) can be easily associated with a speed of the consumption of the water, a cumulative total of the supply amounts (i.e., a cumulative supply amount or a cumulative total supply amount) can be employed as the indicator. The cumulative supply amount is calculated by multiplying the cumulative time by the flow velocity (i.e., a flow velocity relating to the humid-air supply amount per unit time). In each case, association with the concentration of the non-volatile component in the humidification liquid is enabled by actual measurement for obtaining a relationship between each cumulative amount and the concentration.

The maintenance controller 150 includes a flushing-data storage device 151 and a determiner 152. Upon the flushing operation, the maintenance controller 150 controls the head controller 144 to control the actuators. The flushing operation is a preliminary operation for printing and performed based on the flushing data stored in the flushing-data storage device 151. That is, upon receipt of the print signal, the capping is released, and the flushing operation is performed to eject the ink onto the conveyor belt 43.

The flushing-data storage device 151 in its initial state stores base data (i.e., the flushing data) for the flushing operation. This base data contains information regarding the number of drivings of each actuator in the flushing operation. This number is common to all the actuators. The flushing data is rewritable and can be changed back to the initial state as needed.

The determiner 152 determines whether the cumulative time stored in the cumulative-time storage device 146 is longer than a predetermined length of time (as one example of a preset value) or not. When the humidifying operation is continued, that is, the cumulative time increases, the concentration of the non-volatile component in the humidification liquid increases, and an amount of water in the humid air decreases. This may lead to shortages of water to be supplied to the ink near the ejection openings 108, which may cause deterioration of image quality. To solve this problem, when the cumulative time is longer than the predetermined length of time, the maintenance controller 150 increases an amount of the ink discharged in the flushing operation (hereinafter may be simply referred to as "ink discharge amount") when compared with a case where the cumulative time is equal to or shorter than the predetermined length of time. That is, this predetermined length of time is a maximum cumulative time in which the deterioration of the image quality in image recording after a predetermined capping time can be kept to a degree unrecognizable by the user without increase in the ink discharge amount. Within this predetermined length of time, an amount of water equal to or larger than a minimum amount required for maintaining the image quality can be supplied to vicinities of the ejection openings 108 in one humidifying operation. When the cumulative time is longer than the predetermined length of time, the shortages of the water supply may be caused. In the present embodiment, however, when the cumulative time is longer than the predetermined length of time, the ink discharge amount is increased, making it possible to maintain the image quality in printing. Specifically, when the cumulative time is longer than the predetermined length of time, the number of ejections of the ink droplets in the flushing operation is increased. In this operation, the maintenance controller 150 overwrites the flushing data stored in the flushing-data storage device 151. For example, the maintenance controller 150 commands to increase the number of ejections of the ink droplets by 1000 times with respect to the number of ejections in the case where the cumulative time is equal to or shorter than the predetermined length of time (i.e., the flushing data in the initial state). As a modification, an amount of each ink droplet in one ejection may be increased. In this modification, the ink discharge amount is increased even in the same number of ejections.

When the operation for preventing increase in ink viscosity such as the capping and the humidifying operation is performed, the maintenance controller 150 drives the up/down motor 64 for elevating and lowering the movable member 62 (i.e., the distal end 61*a*1 of the projecting portion 61*a*), and the pump 56 of the humid-air supply mechanism 50. The maintenance controller 150 further includes a first coefficient storage device 153, a humidification-time calculator 154, a second coefficient storage device 155, and a humidification-operating-time calculator 156, and these devices and calculators cooperate to calculate the humidification operating time in the humidifying operation.

The first coefficient storage device 153 and the humidification-time calculator 154 are provided for calculating a correction value (i.e., a correction humidification time th) for a base humidification time tr (e.g., 120 seconds) in relation to the cumulative time. The second coefficient storage device 155 and the humidification-operating-time calculator 156 are provided for calculating a length of time in which the humidification is performed (hereinafter may be referred to as "humidification operating time") in relation to environmental conditions (e.g., humidity in the humidifying operation) and the correction humidification time th.

When the humidifying operation is continued, that is, the cumulative time increases, the water of the humidification liquid stored in the tank 54 decreases. Instead, the concentration of the non-volatile component in the humidification liquid increases, resulting in reduction in productivity of the humid air. As a result, the amount of water in the humid air decreases. From the viewpoint of supplying a specific amount of water to the ink near the ejection openings 108 in one humidifying operation, the humidification-time calculator 154 corrects the base humidification time tr to calculate the correction humidification time th.

The first coefficient storage device 153 stores coefficient α that increases with an increase in the cumulative time. In the present embodiment, three coefficient values are set as the coefficient α according to the cumulative time stored in the cumulative-time storage device 146. Specifically, the coefficient α is 1.0 when the cumulative time is equal to or longer than 0 hours and shorter than 200 hours, 1.2 when the cumulative time is equal to or longer than 200 hours and shorter than 500 hours, and 1.5 when the cumulative time is equal to or longer than 500 hours. For example, when the cumulative time is equal to or longer than 500 hours, the correction humidification time th (=α×tr) is 180 seconds (=1.5×120 seconds).

In the humidifying operation, amounts of water supplied to the ink near the ejection openings 108 vary with increased amounts of the viscosity of the ink. For example, under a low humidity condition, the viscosity of the ink easily increases, which increases the amount of the water to be supplied to the ink. Thus, a relatively large amount of water in the tank 54 is consumed in the production of the humid air. In contrast, a high humidity condition requires a smaller amount of the water to be supplied to the ink. Thus, in the high humidity condition, even in a case where the same humidifying time as used in the low humidity condition is used, a smaller amount of water is consumed. Accordingly, in order to supply a proper amount of water in the humidifying operation, the humidification-operating-time calculator 156 corrects the correction humidification time th on the basis of the humidity in the humidifying operation to calculate a humidification operating time t as a humidification time actually used for the humidifying operation.

The second coefficient storage device 155 stores coefficient β that decreases with an increase in the humidity in the humidifying operation. In the present embodiment, three coefficient values are set as the coefficient β according to the humidity in the humidifying operation (i.e., a humidity range). Specifically, the coefficient β is 1.2 when the humidity is equal to or higher than 0% and lower than 30%, 1.0 when the humidity is equal to or higher than 30% and lower than 70%, and 0.8 when the humidity is equal to or higher than 70%. For example, under the high humidity condition in which the humidity is equal to or higher than 70%, the humidification operating time t is calculated by multiplying the correction humidification time th calculated by the humidification-time calculator 154 by 0.8 (the coefficient β). The humidification operating time t is cumulatively added to obtain the cumulative time which is stored into the cumulative-time storage device 146. It is noted that the humidity in the humidifying operation is detected by the humidity sensor 29.

The maintenance controller 150 also performs the cleaning operation for cleaning the conveyor belt 43 after the flushing operation. In this cleaning operation, the maintenance controller 150 controls the moving mechanism 37*c* to move the cleaning-liquid application member 37*a* and the blade 37*b* to the contact position and controls the conveyor mechanism 40 via the conveyance controller 141 to rotate the conveyor belt 43 in the clockwise direction. In this conveyance, a running speed of the conveyor belt 43 is lower than that in the printing. Thus, the cleaning liquid is uniformly applied to the outer circumferential face of the conveyor belt 43, and the foreign matters such as the ink on the outer circumferential face are reliably removed (scraped) by the blade 37*b* together with the cleaning liquid.

Figure 9:
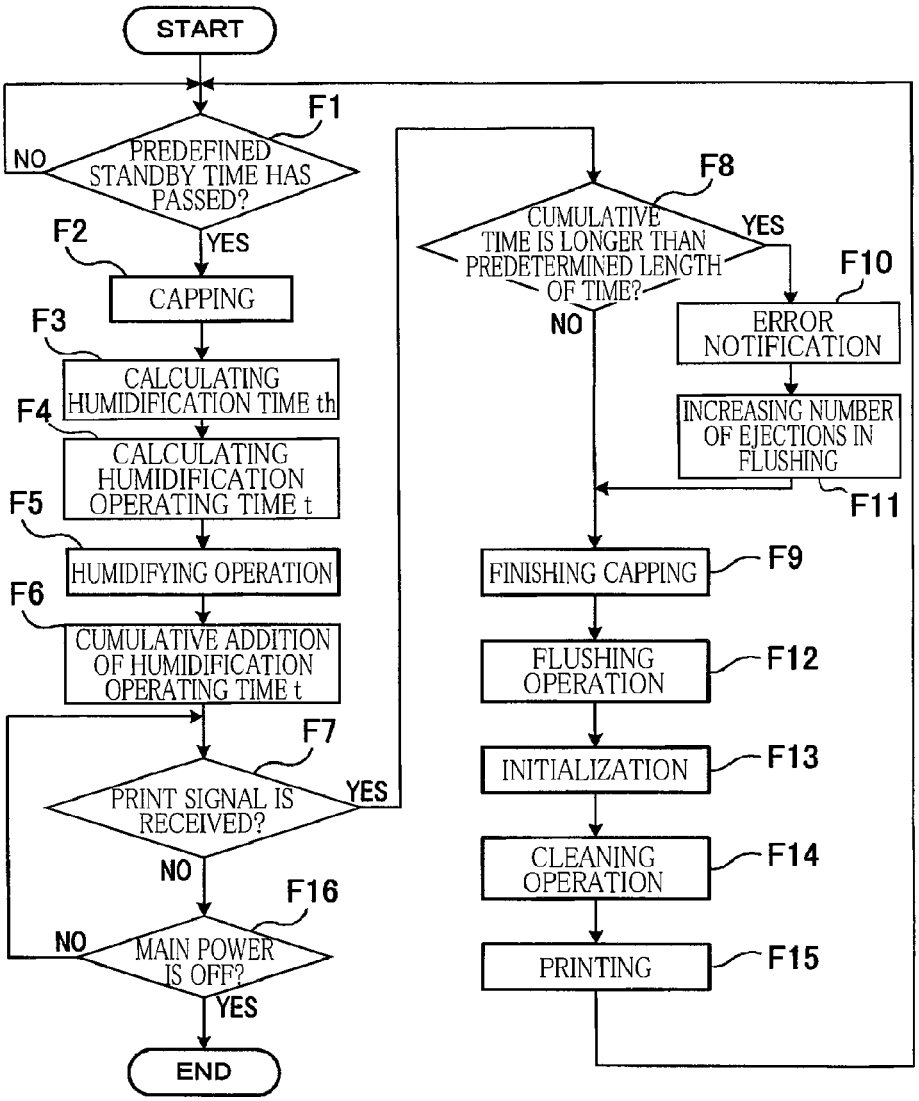
FIG. 9 is a flow chart illustrating a series of operations relating to a maintenance operation controlled by the controller of the printer in FIG. 1.

There will be next explained, with reference to a flow chart in FIG. 9, a flow or a series of processings relating to the maintenance operation. It is noted that a state of the printer 101 at a start of the flow in FIG. 9 is a standby state after completion of the printing. Upon completion of the printing, the time measurer 145 starts time measuring.

This flow begins with step F1 ("step" is omitted where appropriate) at which the controller 100 determines whether a predefined standby time has passed from a completion of a preceding printing or not on the basis a result of the time measuring by the time measurer 145. When the predefined standby time has not passed, this flow repeats the processing in F1. It is noted that, when the print signal is received from the external device before the predefined standby time has passed, the conveyance controller 141 and the head controller 144 performs printing based on the print signal.

On the other hand, when the predefined standby time has passed, the maintenance controller 150 at F2 controls the up/down motor 64 to perform the capping to establish the sealed state of the ejection space S1. Then at F3, the humidification-time calculator 154 calculates the humidification time th. In this calculation, when the cumulative time stored in the cumulative-time storage device 146 is 100 hours, for example, 1.0 is selected as the coefficient α from among the coefficient values stored in the first coefficient storage device 153. The humidification-time calculator 154 then obtains 120 seconds as the humidification time th by multiplying 120 seconds (the base humidification time tr) by 1.0 (the coefficient α). It is noted that the coefficient α increases from 1.0 to 1.2 and 1.5 with the increase in the cumulative time, that is, the humidification time th increases with the increase in the cumulative time. In other words, the longer the cumulative time, the longer the humidification time th becomes.

At F4, the humidification-operating-time calculator 156 calculates the humidification operating time t. In this calculation, the humidity sensor 29 detects humidity of air near the head 1. For example, when the detected humidity is 40%, 1.0 is selected as the coefficient β from among the coefficient values stored in the second coefficient storage device 155. The humidification-operating-time calculator 156 then obtains 120 seconds as the humidification operating time t by multiplying 120 seconds (the humidification time th) by 1.0 (the coefficient β). It is noted that when the detected humidity is lower than a predetermined humidity range (in the present embodiment, the range of equal to or higher than 30% and lower than 70%), the coefficient β is increased from 1.0 to 1.2, resulting in the longer humidification operating time t. That is, the humid-air supply amount increases. On the other hand, when the detected humidity is equal to or higher than the predetermined humidity range (i.e., the range of equal to or higher than 30% and lower than 70%), the coefficient (3 is reduced from 1.0 to 0.8, resulting in the shorter humidification operating time t. That is, the humid-air supply amount is reduced.

At F5, the maintenance controller 150 drives the pump 56 for the humidification operating time t calculated by the humidification-operating-time calculator 156. As a result, the ejection space S1 is filled with the humid air, thereby suppressing drying of the ink near the ejection openings 108. At F6, the humidification operating time t in this humidifying operation is added to the cumulative time stored in the cumulative-time storage device 146. This cumulative addition of the humidification operating time t allows the controller 100 to obtain the indicator indicating the current concentration of the non-volatile component in the humidification liquid stored in the tank 54.

At F7, the controller 100 determines whether the print signal is received or not. When the print signal is received, this flow goes to F8. When the print signal is not received, this flow goes to F16. At F8, the determiner 152 determines whether the cumulative time stored in the cumulative-time storage device 146 is longer than the predetermined length of time or not. When the cumulative time is equal to or less than the predetermined length of time, this flow goes to F9. On the other hand, when the cumulative time is longer than the predetermined length of time, this flow goes to F10 at which the maintenance controller 150 controls the buzzer 27 to produce a sound to notify the user of an error. That is, the processing at F10 notifies the user of a timing for replacing the humidification liquid in the tank 54 with new one. After replacing the humidification liquid in the tank 54 with new one, the user presses the reset button to reset the cumulative time stored in the cumulative-time storage device 146.

At F11, the maintenance controller 150 overwrites the flushing data stored in the flushing-data storage device 151. As a result, the ink discharge amount in the flushing operation is increased when compared with the case where the cumulative time is equal to or less than the predetermined length of time.

At F9, the maintenance controller 150 controls the up/down motor 64 to release the capping to switch the ejection space S1 to the unsealed state. At F12, the maintenance controller 150 performs the flushing operation based on the flushing data stored in the flushing-data storage device 151. That is, when the cumulative time is equal to or shorter than the predetermined length of time, the maintenance controller 150 controls the actuators of the head 1 on the basis of the flushing data being in the initial state. When the cumulative time is longer than the predetermined length of time, the maintenance controller 150 controls the actuators of the head 1 on the basis of the overwritten flushing data. As a result, the flushing operation is performed in which the ink droplet is ejected the set number of times from each of the ejection openings 108 onto the conveyor belt 43. At F13, the maintenance controller 150 initializes the flushing data stored in the flushing-data storage device 151, that is, the flushing data is changed back to the initial state.

At F14, the cleaning operation is performed in which the maintenance controller 150 controls the moving mechanism 37*c* to move the cleaning-liquid application member 37*a* and the blade 37*b* to the contact position and controls the conveyor mechanism 40 via the conveyance controller 141 to rotate the conveyor belt 43 in the clockwise direction. As a result, the cleaning liquid is applied to the outer circumferential face of the conveyor belt 43, and the foreign matters such as the ink on the outer circumferential face are reliably removed by the blade 37*b* together with the cleaning liquid.

At F15, the printing is performed by the conveyance controller 141 and the head controller 144 on the basis of the print signal received at F7, and this flow returns to F1.

At F16, the controller 100 determines a power OFF signal is received or not. When a power button, not shown, of the printer 101 is pressed by the user, this flow returns to F7. On the other hand, when the power button is pressed, the power OFF signal is output from the power button. Upon this output, the printer 101 is turned off, and this flow for the printing and maintenance ends. It is noted that when the power button is thereafter pressed by the user, the printer 101 is turned on.

In the printer 101 according to the present embodiment described above, even when the concentration of the non-volatile component in the humidification liquid increases, the humidification operating time is made longer to increase the humid-air supply amount. Thus, the humidity in the ejection space S1 being in the sealed state can be kept at desirable humidity, making it possible to suppress the drying of the ink near the ejection openings 108.

Also, the cumulative time that is the cumulative total of the humidification operating times is used as the indicator indicating the concentration, and the humidification operating time t (and the humidification time th) increases with the increase in the cumulative time (i.e., the humid-air supply amount). In other words, the longer the cumulative time (the larger the humid-air supply amount), the longer the humidification operating time t (and the humidification time th) is. This makes it possible to suppress the drying of the ink near the ejection openings 108 with simple control.

Also, the humidification operating time is long (that is, the humid-air supply amount is large) when the detected humidity is lower than the predetermined humidity range (i.e., the range of equal to or higher than 30% and lower than 70%), and the humidification operating time is short (that is, the humid-air supply amount is small) when the detected humidity is equal to or higher than the predetermined humidity range. As a result, the humid-air supply amount can be increased or reduced according to humidity conditions near the head 1. Specifically, when the humidity is low, the supply amount can be increased to suppress the drying of the ink near the ejection openings 108. When the humidity is high, the supply amount can be reduced to suppress the increase in the concentration of the non-volatile component in the humidification liquid.

In the humidifying operation in the above-described embodiment, the humid air is the supplied at a uniform flow velocity. Thus, the humidification operating time is made longer with the increase in the concentration of the non-volatile component in the humidification liquid (i.e., the increase in the cumulative supply amount of the humid air) to increase the humid-air supply amount. However, the printer 101 may control the humidifying operation such that the humidification time (i.e., the humidification operating time) is fixed, and the flow velocity of the humid air increases with the increase in the concentration of the non-volatile component in the humidification liquid to increase the humid-air supply amount. It is noted that the flow velocity of the humid air can be adjusted by a rotation speed of the pump 56.

Figure 10:
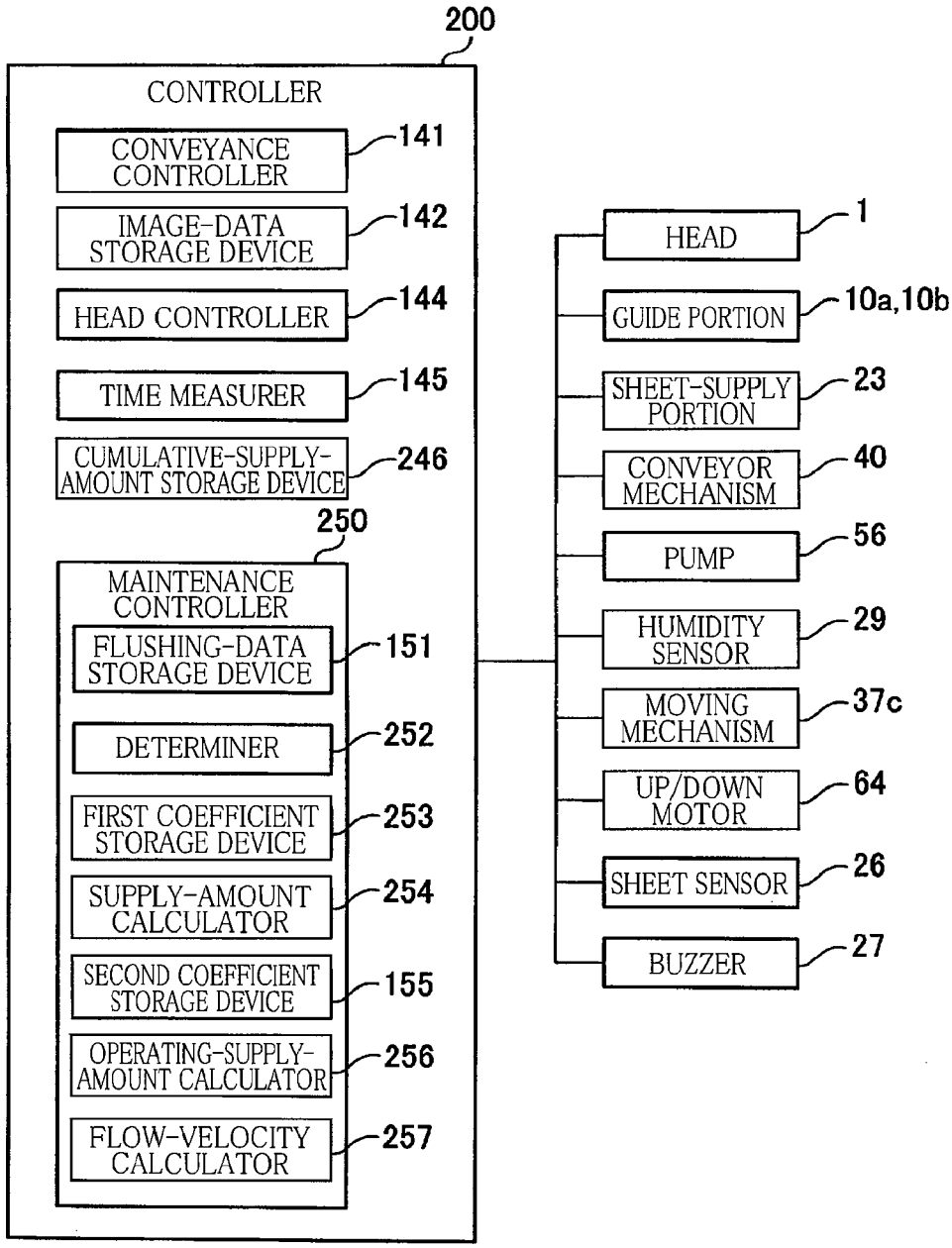
FIG. 10 is a block diagram illustrating a configuration of a controller in a modification of the embodiment of the present invention.

In this modification, as illustrated in FIG. 10, a controller 200 includes: a cumulative-supply-amount storage device 246 instead of the cumulative-time storage device 146; a maintenance controller 250 instead of the maintenance controller 150; a supply-amount calculator 254 instead of the humidification-time calculator 154; an operating-supply-amount calculator 256 instead of the humidification-operating-time calculator 156; a first coefficient storage device 253 instead of the first coefficient storage device 153; a determiner 252 instead of the determiner 152; and a flow-velocity calculator 257. It is noted that the same reference numerals as used in the above-described embodiment are used to designate the corresponding elements of this modification, and an explanation of which is dispensed with.

The cumulative-supply-amount storage device 246 as one example of the indicator obtainer stores the cumulative supply amount that is a cumulative total of operating supply amounts q in respective humidifying operations. It is noted that the cumulative-supply-amount storage device 246 also resets the stored cumulative supply amount in response to the pressing of the reset button by the user after replacement of the humidification liquid in the tank 54 with new one.

The first coefficient storage device 253 stores a coefficient α that increases with the increase in a cumulative-supply-amount range, in other words, the higher the cumulative-supply-amount range, the higher the coefficient α is. For example, the first coefficient storage device 253 stores the coefficient α that increases to 1.0, 1.2, and 1.5 in order in respective first-third cumulative-supply-amount ranges. The third cumulative-supply-amount range is the highest, and the first cumulative-supply-amount range is lowest among these three cumulative-supply-amount ranges. It is noted that the number of the cumulative-supply-amount ranges is not limited to three as long as a plurality of cumulative-supply-amount ranges are provided.

The supply-amount calculator 254 calculates a supply amount qh by multiplying the humidification time tr (e.g., 120 seconds), a base flow velocity v, and the coefficient α together. This coefficient α is selected from among the values stored in the first coefficient storage device 253, on the basis of the cumulative supply amount stored in the cumulative-supply-amount storage device 246.

The operating-supply-amount calculator 256 calculates an operating supply amount q by multiplying the supply amount qh calculated by the supply-amount calculator 254 by the coefficient β. Like the humidification-operating-time calculator 156, this coefficient β is selected from among the coefficient values stored in the second coefficient storage device 155, on the basis of the humidity detected by the humidity sensor 29.

The flow-velocity calculator 257 calculates an operating flow velocity v1 by dividing the operating supply amount q calculated by the operating-supply-amount calculator 256 by the humidification time tr. The maintenance controller 250 controls the pump 56 to supply the humid air at the operating flow velocity v1 for the humidification time tr in the humidifying operation.

The determiner 252 determines whether the cumulative supply amount stored in the cumulative-supply-amount storage device 246 is larger than a predetermined amount (i.e., a predetermined value) or not. When the cumulative supply amount is larger than the predetermined amount, the maintenance controller 250 makes the ink discharge amount (i.e., the number of ejections of the ink droplets in the flushing operation) larger than when the cumulative supply amount is equal to or smaller than the predetermined amount. This predetermined amount is an upper limit value of a cumulative total of the operating supply amounts as the cumulative supply amount. When the cumulative supply amount is larger than the upper limit value, a lot of water in the tank 54 is consumed, resulting in the higher concentration of the non-volatile component in the humidification liquid. Thus, as in the above-described embodiment, when the cumulative supply amount is larger than the predetermined amount, the ink discharge amount is increased.

There will be next explained a flow or a series of processings relating to a maintenance operation in this modification. It is noted that an explanation of the same processings as executed in the above-described embodiment is dispensed with.

Also in this modification, this flow starts with F1 and goes to F2 and F3. At F3, the supply-amount calculator 254 calculates the supply amount qh. In this calculation, the coefficient α increases with the increase in the cumulative supply amount, whereby the supply amount qh increases.

At F4, the operating-supply-amount calculator 256 calculates the operating supply amount q. In this calculation, the humidity sensor 29 detects the humidity near the head 1. It is noted that when the detected humidity is lower than the predetermined humidity range (i.e., the range of equal to or higher than 30% and lower than 70%), the coefficient β is increased from 1.0 to 1.2, resulting in the larger operating supply amount. On the other hand, when the detected humidity is equal to or higher than the predetermined humidity range, the coefficient β is reduced from 1.0 to 0.8, resulting in the smaller operating supply amount. Also, in this calculation, the flow-velocity calculator 257 calculates the operating flow velocity v1.

At F5, the maintenance controller 250 drives the pump 56 for the humidification time tr. The flow velocity of the humid air supplied by the pump 56 in this operation is set at the operating flow velocity v1. As a result, a desired amount (i.e., the operating supply amount) of the humid air is supplied to the ejection space S1, thereby suppressing drying of the ink near the ejection openings 108. At F6, the operating supply amount q in this humidifying operation is added to the cumulative supply amount stored in the cumulative-supply-amount storage device 246. This cumulative addition of the operating supply amount q allows the controller 100 to obtain the indicator indicating the current concentration of the non-volatile component in the humidification liquid stored in the tank 54.

Upon completion of the processing at F7, the determiner 252 at F8 determines whether the cumulative supply amount stored in the cumulative-supply-amount storage device 246 is larger than the predetermined amount (i.e., the predetermined value) or not. When the cumulative supply amount is equal to or smaller than the predetermined amount, this flow goes to F9. On the other hand, when the cumulative supply amount is larger than the predetermined amount, this flow goes to F10. That is, the user is notified of a timing for replacing the humidification liquid in the tank 54 with new one. After replacing the humidification liquid in the tank 54 with new one, the user presses the reset button to reset the cumulative supply amount stored in the cumulative-supply-amount storage device 246. At F11, the flushing data is overwritten.

This flow then goes to F9, and F12-F15 and returns to F1. The processing at F16 is the same as in the above-described embodiment. As a result, the printer 101 is turned off, and this flow for the printing and maintenance ends.

Also in the printer according to the present modification as described above, the same effects as obtained in the above-described embodiment can be obtained for the same configurations as employed in the above-described embodiment. The cumulative supply amount that is the cumulative total of the operating supply amounts is used as the indicator indicating the concentration, and the operating flow velocity v1 increases with the increase in the cumulative supply amount. In other words, the larger the cumulative supply amount, the higher the operating flow velocity v1 is. This makes it possible to suppress the drying of the ink near the ejection openings 108 with simple control.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, the humidity sensor 29 may be omitted. In this configuration, the second coefficient storage device 155 and the humidification-operating-time calculator 156 in the above-described embodiment may also be omitted, and the pump 56 is driven in the humidifying operation for the humidification time th calculated by the humidification-time calculator 154. Also in the above-described modification, the second coefficient storage device 155 and the operating-supply-amount calculator 256 may be omitted. In this configuration, the flow-velocity calculator 257 needs to calculate the operating flow velocity v1 on the basis of the supply amount calculated by the supply-amount calculator 254 to supply the humid air at the obtained operating flow velocity v1. Furthermore, the buzzer 27 may be omitted.

While the first coefficient storage device 153 stores the three values as the coefficient α in the present embodiment, the first coefficient storage device 153 may store any number of values as the coefficient α as long as a plurality of values are stored. It is to be understood that the first coefficient storage device 153 may store a relationship between the coefficient α and the humidity in functional format. Likewise, the second coefficient storage device 155 may store any number of values as the coefficient β as long as a plurality of values are stored. Also, the second coefficient storage device 155 may store a relationship between the coefficient β and the humidity in functional format.

As the capping mechanism capable of switching the ejection space S1 selectively to one of the sealed state and the unsealed state, there may be employed a mechanism including: a cap having a bottom portion opposite the ejection face 1*a* and an enclosing portion provided upright on a peripheral portion of the bottom portion; and a moving mechanism configured to move the cap selectively to one of a position at which a distal end of the enclosing portion contacts the ejection face 1*a* and a position at which the distal end is distant from the ejection face 1*a*. In this configuration, the bottom portion of the cap only needs to have a supply opening for supplying the humid air and a discharge opening for discharging the humid air.

In the above-described embodiment, when the humidification liquid in the tank 54 is reduced to such an amount that causes the shortages of the water supply, the humidification liquid in the tank 54 is replaced with new one. Nevertheless, humidification liquid may be replenished or added to the humidification liquid in the tank 54. The non-volatile component is not consumed in the humidifying operation and accordingly accumulated. An increase in the number of additions causes early shortages of the water supply, considering an appearance of the remaining amount. To solve this problem, for example, a counter for counting the number of additions may be provided for allowing the controller to correct the predetermined length of time on the basis of the obtained count value. For example, a coefficient γ is provided, and the controller reduces the predetermined length of time with the increase in the number of additions. In this configuration, a plurality of coefficients γ may be provided, and a relationship between the coefficient γ and the cumulative time may be provided or stored in functional format. Also, the printer 101 may be configured such that the humidification liquid is replaced with new one when the count value becomes equal to or greater than a predefined number of times or when a concentration of the non-volatile component in the humidification liquid which concentration is indicated by a value obtained by the above-described function is greater than a predefined value. Also, a tank cleaning may be performed to replace the humidification liquid. There will be explained, with reference to FIGS. 11 and 12, a structure of a printer 101 capable of performing the tank cleaning. It is noted that the same reference numerals as used in the above-described embodiment are used to designate the corresponding elements of this modification, and an explanation of which is dispensed with.

Figure 11:
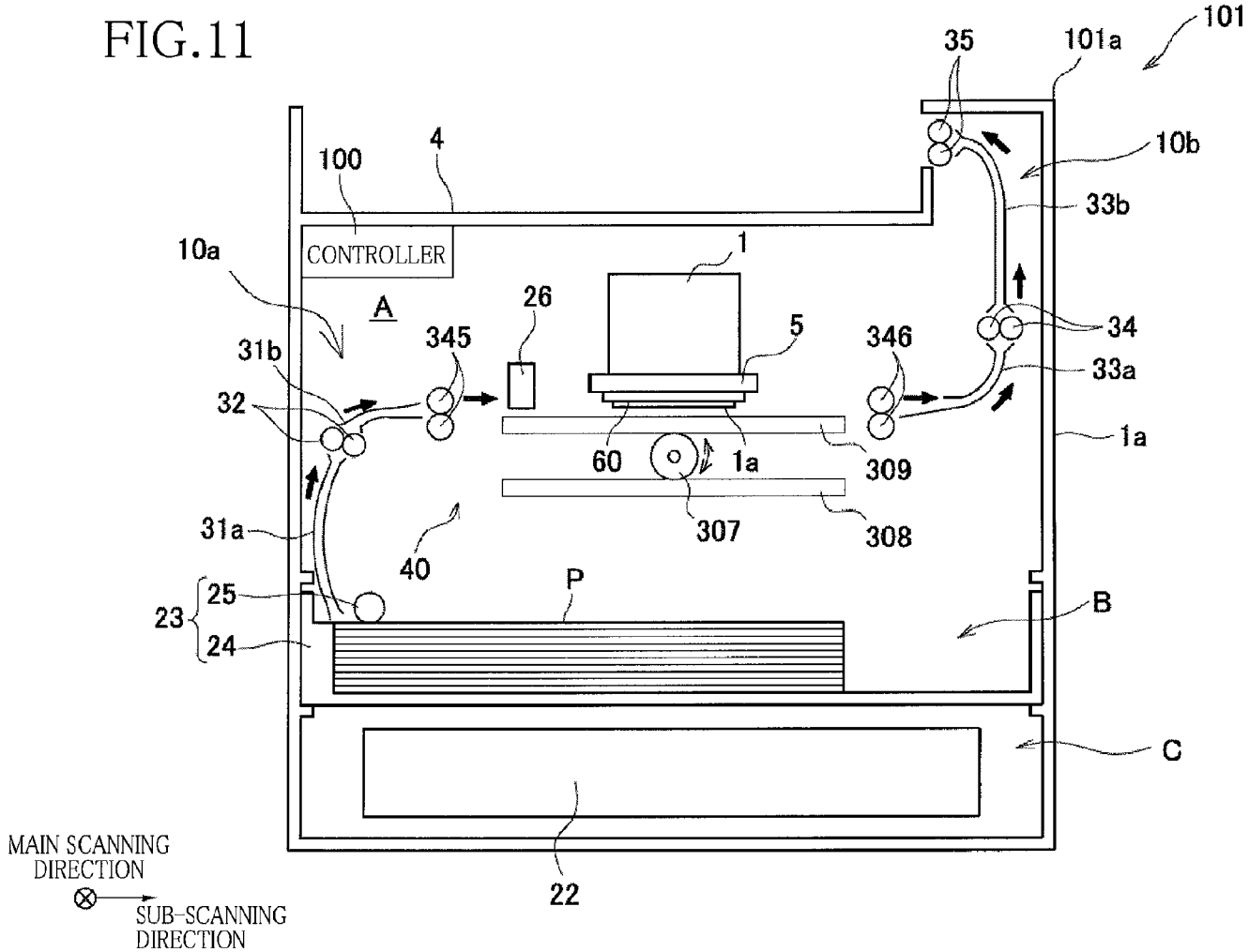
FIG. 11 is a side view generally illustrating an internal structure of an ink-jet printer as another modification.

As illustrated in FIG. 11, the conveyor mechanism 40 includes: a platen 309; and conveyor roller pairs 345, 346 arranged on opposite sides of the platen 309 in the conveying direction. Each of the conveyor roller pairs 345, 346 is constituted by a pair of rollers arranged opposite each other so as to nip the sheet P in an up and down direction. Each of the conveyor roller pairs 345, 346 nips and conveys the sheet P in the conveying direction. The conveyor roller pair 345 disposed upstream of the head 1 in the conveying direction conveys the sheet P in the conveying direction, with the sheet P supported on an upper face of the platen 309. On a downstream side of the upper face of the platen 309, the conveyor roller pair 346 conveys the sheet P in the conveying direction toward the sheet-output portion 4.

An inverting mechanism 307 is disposed under the head 1. The platen 309 and a glass table 308 are fixed to the inverting mechanism 307 so as to be opposed to each other. The inverting mechanism 307 is operable to establish a state in which one of the platen 309 and the glass table 308 faces the ejection face 1*a* of the head 1. In the image recording operation, for example, the inverting mechanism 307 establishes a state in which the platen 309 faces the ejection face 1*a*. When the humidifying operation or the tank cleaning is performed in this state, the inverting mechanism 307 is moved downward to avoid contact of the platen 309 and the glass table 308 with the ejection face 1*a*, then rotated to have the glass table 308 face the ejection face 1*a*, and finally moved upward.

Figure 12:
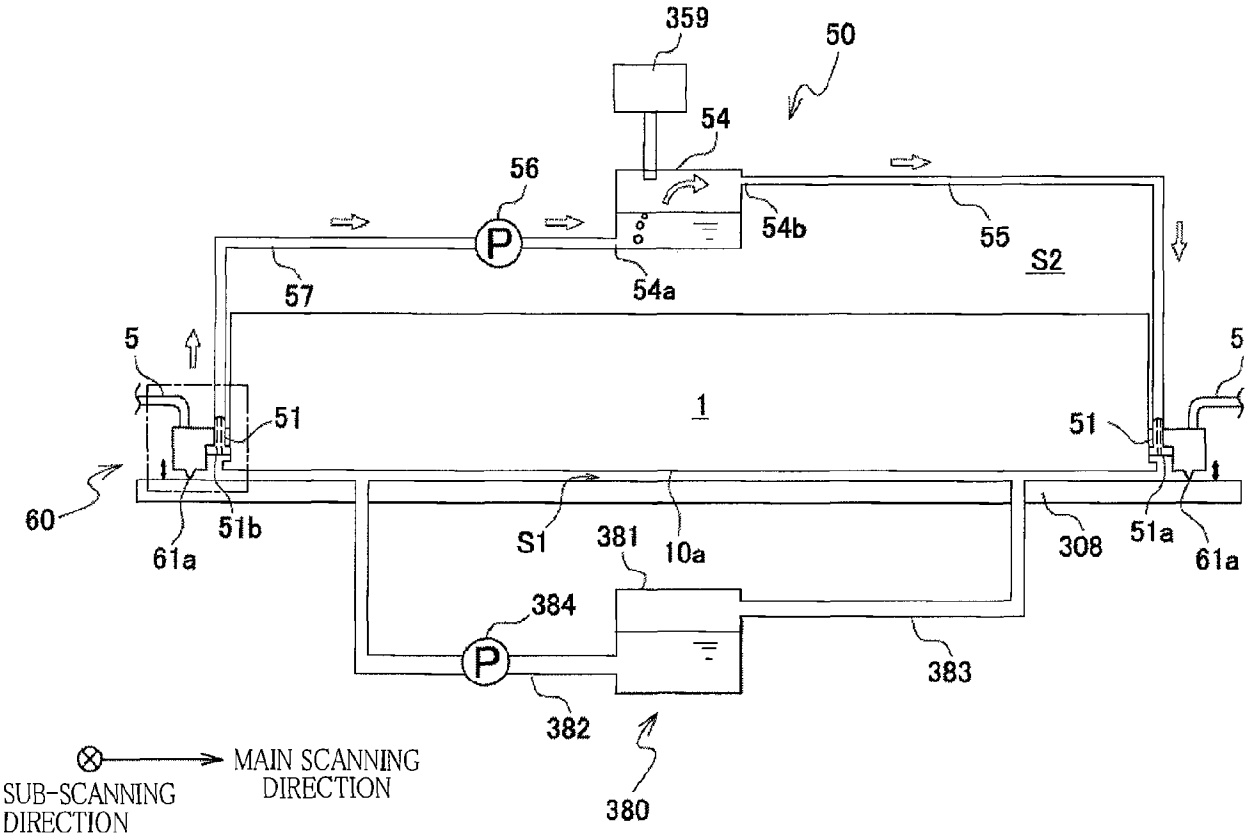
FIG. 12 is a schematic view illustrating a head holder, a humid-air supply mechanism, and a collecting mechanism in the modification.

As illustrated in FIG. 12, the glass table 308 is provided with a collecting mechanism 380 as one example of a liquid discharge mechanism that includes a waste liquid tank 381, tubes 382, 383, and a collecting pump 384. Each of the tubes 382, 383 is connected to the waste liquid tank 381 and the glass table 308 to fluidically couple the waste liquid tank 381 and the ejection space S1 with each other. The collecting pump 384 is provided on the tube 382. The humidification liquid supplied from the opening 51*a* in the tank cleaning is stored in the ejection space S1, and then the collecting pump 384 is driven to deliver waste liquid stored in the ejection space S1, into the waste liquid tank 381 through the tube 382. During this delivery, air in the waste liquid tank 381 is supplied into the ejection space S1 through the tube 383. These configuration and operation allow smooth collection of the waste liquid stored in the ejection space S1.

Upon the tank cleaning, the sealed state is established, and the pump 56 is temporarily rotated forwardly to forcibly supply air into the tank 54. The air supplied agitates the humidification liquid stored in the tank 54, so that deposits of the non-volatile component accumulated on a bottom face of the tank 54 float up. When the pump 56 is thereafter rotated reversely, the non-volatile component is discharged into the ejection space S1 via the opening 51*b* together with the humidification liquid. While all the humidification liquid stored in the tank 54 is discharged in the present modification, not all the humidification liquid (e.g., a fixed amount of the humidification liquid) may be discharged so that a certain amount of the humidification liquid remains in the tank 54. Immediately after the discharge of the humidification liquid is finished, a humidification-liquid supply mechanism 359 supplies new humidification liquid into the tank 54.

Figure 13:
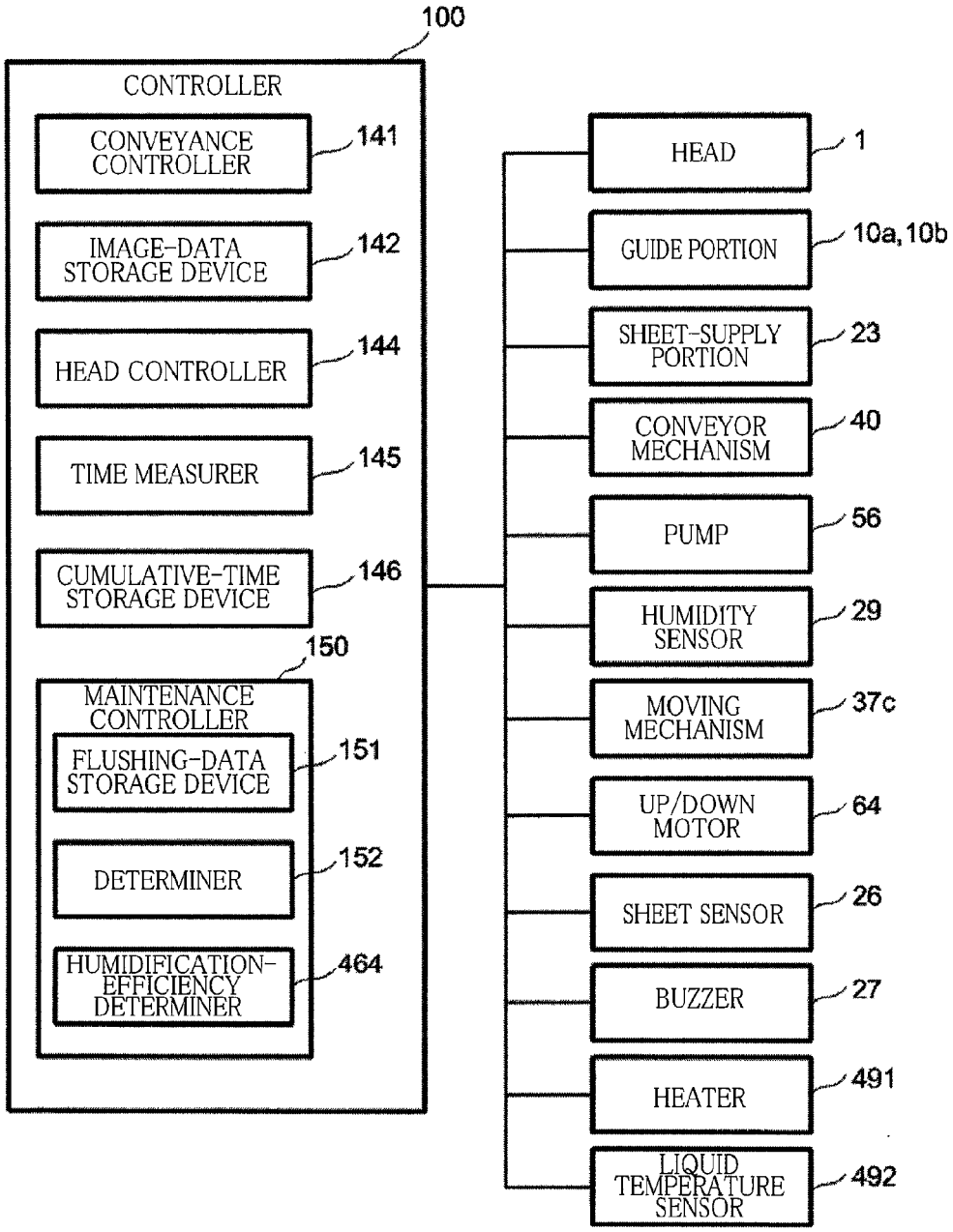
FIG. 13 is a block diagram illustrating a configuration of a controller in another modification.

Also, the printer 101 may include a heater to change efficiency of the humidification (hereinafter may be referred to as "humidification efficiency"). Specifically, as illustrated in FIG. 13, the printer 101 further includes: a heater 491 for adjusting a temperature of the humidification liquid stored in the tank 54; and a liquid temperature sensor 492, attached to the tank 54, for detecting the temperature of the humidification liquid stored in the tank 54, and the maintenance controller 150 includes a humidification-efficiency determiner 464. The liquid temperature sensor 492 senses the temperature of the humidification liquid stored in the tank 54, based on which the humidification-efficiency determiner 464 changes an electric input to the heater 491 to adjust the temperature of the humidification liquid stored in the tank 54. Here, the heater 491 is a common heater such as a sheathed heater. The higher the temperature of the humidification liquid stored in the tank 54, the more easily the water of the humidification liquid vaporizes. Thus, even if the concentration of the non-volatile component in the humidification liquid stored in the tank 54 becomes high, raising the temperature of the humidification liquid to increase the humidification efficiency can suppress a reduction in a humidification performance. Thus, the humidification-efficiency determiner 464 raises the temperature of the humidification liquid stored in the tank 54 with the increase in the cumulative time stored in the cumulative-time storage device 146. With the printer 101 according to the present modification, the humidification efficiency is increased with the increase in the concentration of the non-volatile component in the humidification liquid, thereby reducing a change in efficiency of the vaporization of the water of the humidification liquid stored in the tank 54 due to the increase in the concentration of the non-volatile component in the humidification liquid. This makes it possible to suppress the reduction in the humidification performance.

Also, the humidification efficiency may be controlled by other methods. For example, the printer 101 may employ an ultrasonic humidifier whose output is controlled to adjust the humidification efficiency. That is, any configuration may be employed for producing the humid air as long as the humidification efficiency can be adjusted.

While the humidifying operation is performed in the sealed state in which the ejection space S1 is substantially isolated from the outside space S2 in the above-described embodiment, the humidifying operation may be performed in the unsealed state in which the ejection space S1 is not isolated from the outside space S2. That is, as illustrated in FIG. 7, the humidifying operation may be performed, with the projecting portion 61*a* located at the distant position at which the distal end 61*a*1 is distant from the conveyor belt 43. In this configuration, the humidifying operation may be performed during printing.

While the controller executes the processings on the basis of the cumulative time stored in the cumulative-time storage device 146 (see FIGS. 8 and 10) in the above-described embodiment, the controller may store an amount of the non-volatile component of the humidification liquid stored in the tank 54, to execute the processings on the basis of this amount of the non-volatile component. Assuming that the amount of the humidification liquid stored in the tank 54 is the same, performance of the vaporization decreases with an increase in the amount of the non-volatile component. Thus, the controller increases the driving time of the pump 56 or the flow velocity (as in the above-described embodiment) with the increase in the amount of the non-volatile component, or raises the temperature of the humidification liquid using the heater 491 with the increase in the amount of the non-volatile component to increase an amount of water of the humid air to be supplied into the ejection space S1 per unit time, thereby suppressing the reduction in the humidification performance.

Figure 14:
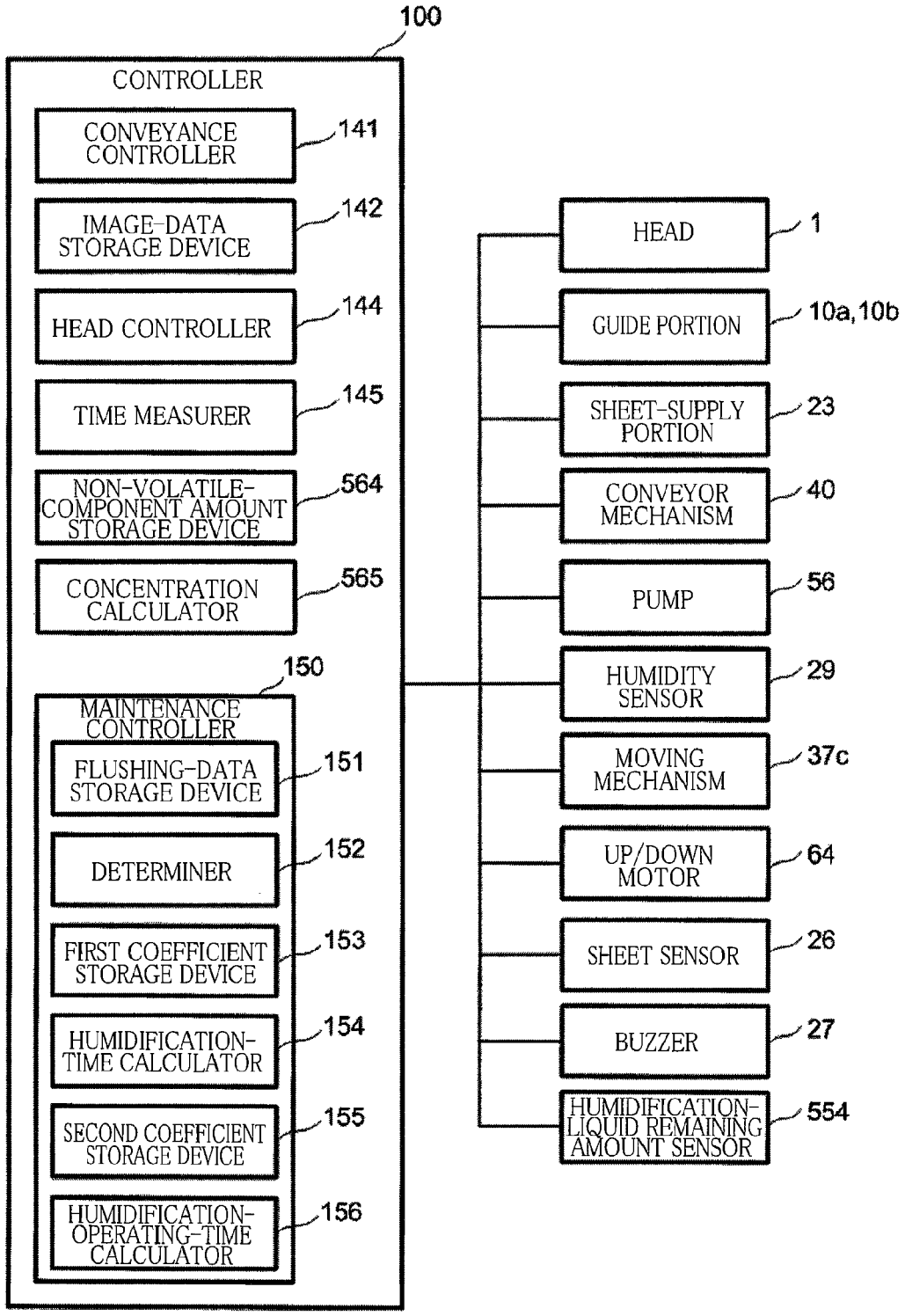
FIG. 14 is a block diagram illustrating a configuration of a controller in another modification.

Also, in the above-described embodiment, the cumulative time stored in the cumulative-supply-amount storage device 246 is employed as the indicator indicating the concentration of the non-volatile component in the humidification liquid. Nevertheless, the amount of the non-volatile component contained in the humidification liquid may be divided by an amount of the humidification liquid to obtain the current concentration of the non-volatile component in the humidification liquid stored in the tank 54. Specifically, as illustrated in FIG. 14, a humidification-liquid remaining amount sensor 554 obtains the amount of the humidification liquid stored in the tank 54. A non-volatile-component amount storage device 564 stores the amount of the non-volatile component contained in the humidification liquid supplied into the tank 54. A concentration calculator 565 calculates the concentration of the non-volatile component in the humidification liquid stored in the tank 54.

Also, the concentration of the non-volatile component in the humidification liquid stored in the tank 54 may be measured directly. The direct measurement includes an optical concentration measurement and a concentration (density) measurement using a weight density meter or calculator.

Figure 15:
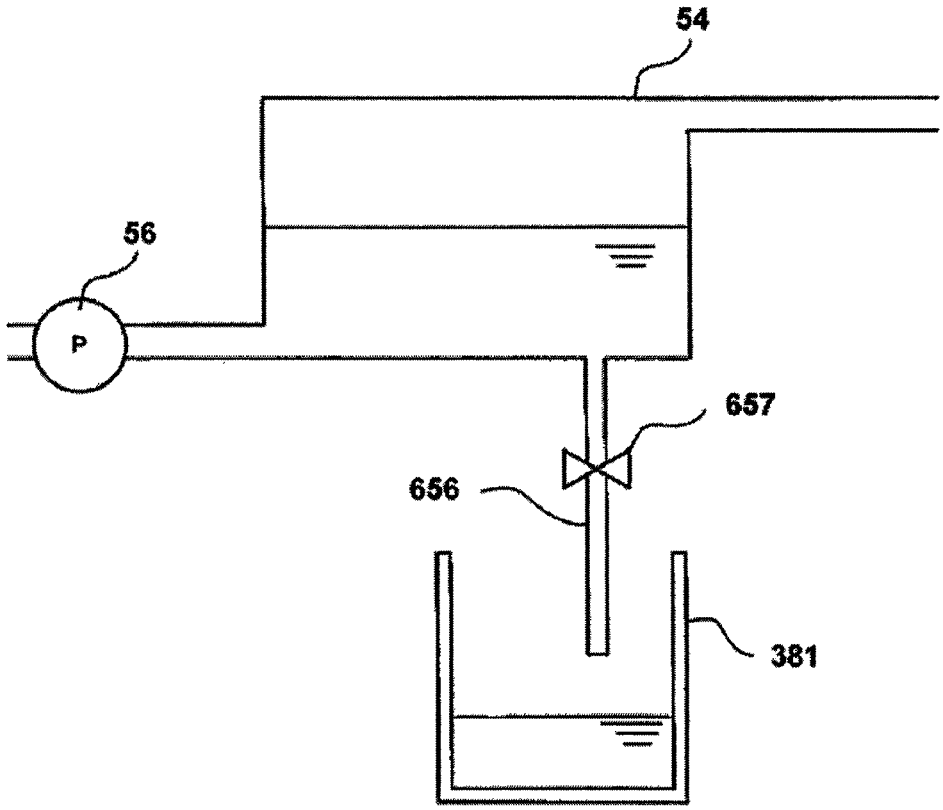
FIG. 15 is a view for explaining a collection of humidification liquid in another modification.

Also, while the humidification liquid in the tank 54 is discharged through the tube 57 in the above-described modification, the humidification liquid in the tank 54 may be discharged through a discharge passage 656 communicating with the tank 54 as illustrated in FIG. 15. In this configuration, a discharge valve 657 is attached to the discharge passage 656. The maintenance controller controls the discharge valve 657 to open to discharge the humidification liquid stored in the tank 54 into the waste liquid tank 381.

In the above-described embodiment, when the cumulative time stored in the cumulative-time storage device 146 is longer than the predetermined length of time, the user is notified of the timing for replacing the humidification liquid in the tank 54 with new one. Nevertheless, the printer 101 may be configured such that the humidification liquid in the tank 54 is automatically discharged.

Also, while the tube 57 communicates with the tank 54 underwater in the above-described embodiment, the tube 57 may not communicate with the tank 54 underwater. This is because the water of the humidification liquid stored in the tank 54 vaporizes by the air circulation via the tank 54, resulting in the humidification of the air.

Also, while the humid air is circulated in the humidifying operation in the above-described embodiment, the printer 101 may be configured such that the humid air supplied into the ejection space may not be circulated.

It is noted that, while the tube 383 is open in the ejection space S1 in FIG. 12, the tube 383 may not be provided. In this case, the ejection space S1 is fluidically coupled with the ambient air in the collection of the discharged humidification liquid to discharge the air from the waste liquid tank 381 to the ambient air, ensuring the reliable collection of the humidification liquid.

Also, the projecting portion 61*a* (see FIGS. 6 and 7) may not be movable as in the above-described embodiment. For example, the projecting portion may be immovably fixed to the head holder such that a position of the distal end 61*a*1 of the projecting portion 61*a* relative to the ejection face 1*a* is fixed. In this configuration, the head holder or a support face of a medium support portion (e.g., the outer circumferential face of the conveyor belt 43) is moved downward or upward to change a position of the distal end 61*a*1 of the projecting portion 61*a* relative to the support face, whereby the projecting portion 61*a* is selectively moved to one of the contact position and the distant position.

Figure 16:
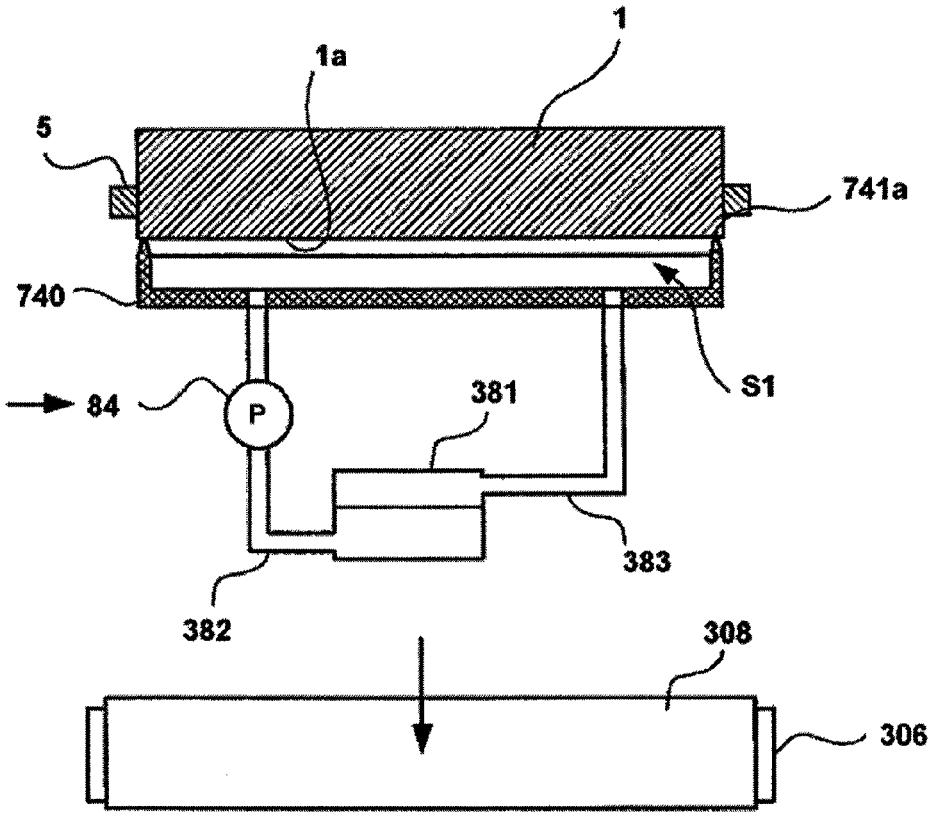
FIG. 16 is a view illustrating a cap in another modification.

Also, as illustrated in FIG. 16, a cap 740 may be provided independently of the head 1. In this configuration, for example, the cap 740 is moved to a position opposed to the ejection face 1*a* after the conveyor mechanism 40 is lowered. At least one of the head 1 and the cap 740 is moved upward and/or downward to selectively position the cap 740 to one of a contact position at which a distal end portion 741*a* of the cap 740 is held in contact with the ejection face 1*a* and a distant position at which the distal end portion 741*a* is spaced apart from the ejection face 1*a*. When the cap 740 is located at the contact position, the ejection space is substantially isolated from the outside space by the cap 740 (that is, a sealed state is established). When the cap 740 is located at the distant position, the ejection space is open to the outside space (that is, an unsealed state is established). In the construction in FIG. 16, the humid-air supply mechanism 50 may be provided on the cap 740. In this configuration, when the pump 56 is rotated reversely to discharge the humidification liquid stored in the tank 54 into the cap 740, it becomes easy for the discharged humidification liquid to flow into the tube 55. Thus, closing the opening 51*a* is effective. For example, when the pump 56 is rotated reversely, an air communication valve, not shown, attached to an upper portion of the tank 54 is opened to introduce air from the outside so as not to hinder the driving of the pump 56 due to the discharge of the air from the tank 54.

Also, in the above-described tank cleaning, immediately before the non-volatile component is discharged together with the humidification liquid, the pump 56 is rotated forwardly to forcibly supply the air into the tank 54 to agitate the humidification liquid. Nevertheless, the humidification liquid may not be agitated. Also, in the above-described modification, when the tank cleaning is performed, the waste liquid discharged from the tank 54 (i.e., humidification liquid having a high concentration of the non-volatile component) is collected by the collecting mechanism 380 (see FIG. 12) that stores the collected waste liquid into the waste liquid tank 381. Nevertheless, an absorber in the form of a foam may be disposed in the waste liquid tank 381 to absorb the waste liquid. Since the absorber retains the waste liquid therein in this configuration, if the printer 101 falls, it is possible to prevent the waste liquid from leaking from the waste liquid tank 381.

Also, while the maintenance controller controls the humidification time or the humidification efficiency on the basis of the concentration of the non-volatile component in the humidification liquid stored in the tank 54 in the above-described embodiment, the maintenance controller may be configured to control both of the humidification time (i.e., an amount of the humid air to be supplied) and the humidification efficiency.

Also, a shape and a position of each of an inlet and an outlet of the circulation channel are not limited in particular as long as the inlet and the outlet are formed in the head, the head holder, and/or the cap and opens to the ejection space. For example, one of the inlet and the outlet may be formed in the head, and the other in the head holder. These openings may be formed in the projecting portion of the cap. The openings may be formed on opposite sides of the ejection face 1*a* (that may be hereinafter read as ejection-opening groups where the openings are formed in the head) in plan view in the sub-scanning direction. Alternatively, the openings may be formed on such positions that the ejection face 1*a* is not interposed between the openings in plan view, that is, the openings may be formed only on one side of the ejection face 1*a* in one direction.

It is noted that, while the non-volatile component is a component(s) of the preservative in the above-described embodiment, any kind of components may be the non-volatile component as long as the components accumulate in the tank 54 and deteriorates the humidification performance.

It is noted that the humid air is supplied from the tank 54 into the ejection space S1 at the uniform flow velocity in the humidifying operation in the above-described embodiment, and the humid air is supplied from the tank 54 into the ejection space S1 at the humidification time tr in the humidifying operation in the above-described modification. Nevertheless, the present invention is not limited to these configurations. For example, the printer 101 may be configured such that the cumulative supply amount is employed as the indicator indicating the concentration of the non-volatile component in the humidification liquid stored in the tank 54, and the controller increases the humidification time tr and the flow velocity of the supply of the humid air with the increase in this cumulative supply amount to increase the supply amount.

Also, while the supply amount is changed at F4 depending upon whether the detected humidity is within the predetermined humidity range or not in the above-described embodiment and modification, the present invention is not limited to this configuration. For example, the supply amount may be determined such that the supply amount is larger in a situation where the humidity detected by the humidity sensor 29 is low than in a situation where the humidity detected by the humidity sensor 29 is high.

The present invention is also applicable to a line printer and a serial printer. Also, the present invention is applicable not only to the printer but also to devices such as a facsimile machine and a copying machine. Furthermore, the present invention is applicable to a liquid ejection apparatus configured to eject liquid other than the ink to perform the recording. The recording medium is not limited to the sheet P, and various recordable media may be used. The present invention may be applied to a liquid ejection apparatus employing any ink ejection method. For example, piezoelectric elements are used in the present embodiment, but various methods may be used such as a resistance heating method and an electrostatic capacity method.

What is claimed is:

1. A liquid ejection apparatus, comprising:

a head comprising an ejection face that comprises an ejection opening through which liquid is ejected by the head;

a humid-air supplier comprising a storage portion for storing humidification liquid comprising water and a non-volatile component, the humid-air supplier being configured to perform a humidifying operation in which humid air humidified by the humidification liquid is supplied into a space located in a vicinity of the ejection face;

an indicator obtainer configured to obtain an indicator indicating a concentration of the non-volatile component in the humidification liquid stored in the storage portion; and a controller configured to control the humid-air supplier, the controller being configured to control the humid-air supplier to at least one of: increase a humid-air supply amount in the humidifying operation with an increase in the concentration indicated by the indicator obtained by the indicator obtainer; and increase an amount of water of the humid air to be supplied into the space located in the vicinity of the ejection face in the humidifying operation with the increase in the concentration indicated by the indicator obtained by the indicator obtainer, wherein the humid-air supply amount is an amount of the humid air to be supplied into the space located in the vicinity of the ejection face.

2. The liquid ejection apparatus according to claim 1, further comprising a capping mechanism configured to switch a state of an ejection space opposed to the ejection face, between (i) a sealed state in which the ejection space is substantially isolated from an outside space and (ii) an unsealed state in which the ejection space is open to the outside space, wherein the controller is configured to control the humid-air supplier to perform the humidifying operation after the controller controls the capping mechanism to switch the ejection space to the sealed state.

3. The liquid ejection apparatus according to claim 2, wherein the storage portion comprises: an air inlet through which air flows into the storage portion; and an air outlet through which air flows out of the storage portion, wherein the capping mechanism comprises: a first opening and a second opening that differs from the first opening, wherein the humid-air supplier comprises: a first air passage connected at one end thereof to the air outlet and connected at another end thereof to the first opening; a second air passage connected at one end thereof to the air inlet and connected at another end thereof to the second opening; and a pump configured to circulate air, and wherein the controller is configured to control the pump such that air in the ejection space is delivered into the storage portion via the second opening, the second air passage, and the air inlet, thereafter the air delivered into the storage portion is humidified by the humidification liquid stored in the storage portion, and thereafter the air humidified by the humidification liquid is supplied into the ejection space via the air outlet, the first air passage, and the first opening.

4. The liquid ejection apparatus according to claim 1, wherein the humid-air supplier is configured to perform a plurality of humidifying operations each as the humidifying operation, wherein the indicator obtainer is configured to obtain, as the indicator, a cumulative supply amount that is a cumulative total of respective humid-air supply amounts in the plurality of humidifying operations, and wherein the controller is configured to control the humid-air supplier to increase the humid-air supply amount in each of the plurality of humidifying operations with an increase in the cumulative supply amount.

5. The liquid ejection apparatus according to claim 4, wherein the humid-air supplier is configured to supply the humid air at a preset flow velocity in each of the plurality of humidifying operations, and wherein the controller is configured to control the humid-air supplier to increase a humid-air supply time in each of the plurality of humidifying operations with the increase in the cumulative supply amount, wherein the humid-air supply time is a length of time for supplying the humid air into the ejection space.

6. The liquid ejection apparatus according to claim 4, wherein the humid-air supplier is configured to supply the humid air at a preset flow velocity in each of the plurality of humidifying operations, wherein the indicator obtainer is configured to obtain, as the indicator, a cumulative time that is a cumulative total of respective humid-air supply times in the plurality of humidifying operations, wherein each of the humid-air supply time is a length of time for supplying the humid air into the ejection space, and wherein the controller is configured to control the humid-air supplier to increase the humid-air supply time in each of the plurality of humidifying operations with an increase in the cumulative time.

7. The liquid ejection apparatus according to claim 4, wherein the humid-air supplier is configured to supply the humid air at a preset flow velocity in each of the plurality of humidifying operations, and wherein the indicator obtainer is configured to obtain, as the indicator, a cumulative time that is a cumulative total of respective humid-air supply times in the plurality of humidifying operations, wherein each of the humid-air supply time is a length of time for supplying the humid air into the ejection space.

8. The liquid ejection apparatus according to claim 4, wherein the humid-air supplier is configured to supply the humid air for a preset length of time in the humidifying operation, and wherein the controller is configured to control the humid-air supplier to increase a flow velocity of the humid air in each of the plurality of humidifying operations with the increase in the cumulative supply amount.

9. The liquid ejection apparatus according to claim 4, wherein the humid-air supplier is configured to supply the humid air for a preset length of time in the humidifying operation, and wherein the controller is configured to control the humid-air supplier to increase a flow velocity of the humid air in each of the plurality of humidifying operations with the increase in the concentration indicated by the indicator obtained by the indicator obtainer.

10. The liquid ejection apparatus according to claim 1, further comprising a detector portion configured to detect humidity in a vicinity of the head, wherein the controller is configured to control the humid-air supplier to increase the humid-air supply amount when the humidity detected by the detector portion is less than a preset range, and wherein the controller is configured to control the humid-air supplier to reduce the humid-air supply amount when the humidity detected by the detector portion is greater than the preset range.

11. The liquid ejection apparatus according to claim 1, further comprising a detector portion configured to detect humidity in a vicinity of the head, wherein the controller is configured to control the humid-air supplier such that the humid-air supply amount in the humidifying operation is greater in a situation in which the humidity detected by the detector portion is low than in a situation in which the humidity detected by the detector portion is high.

12. The liquid ejection apparatus according to claim 1, further comprising a liquid discharger configured to perform a liquid discharge operation for forcibly discharging the liquid from the ejection opening, wherein the controller is configured to control the liquid discharger to perform the liquid discharge operation after the controller controls the capping mechanism to switch the ejection space to the unsealed state after the humidifying operation, and wherein the controller is configured to control the liquid discharger such that an amount of the liquid discharged in the liquid discharge operation is greater in a situation in which the concentration indicated by the indicator is greater than a preset value than in a situation in which the concentration indicated by the indicator is equal to or less than the preset value.

13. The liquid ejection apparatus according to claim 12, further comprising a notifier configured to notify a user when the concentration indicated by the indicator is greater than the preset value.

14. The liquid ejection apparatus according to claim 12, wherein the liquid discharger comprises an energy applier configured to apply ejection energy to the liquid in the head to cause the head to eject a liquid droplet from the ejection opening, and wherein the controller is configured to control the energy applier to perform, as the liquid discharge operation, a flushing operation in which the head ejects the liquid droplet from the ejection opening.

15. The liquid ejection apparatus according to claim 1, further comprising a heater configured to heat the humidification liquid stored in the storage portion, wherein the controller is configured to control the heater to raise a temperature of the humidification liquid stored in the storage portion with the increase in the concentration indicated by the indicator obtained by the indicator obtainer.

16. The liquid ejection apparatus according to claim 1, further comprising:

a storage device configured to store an amount of the non-volatile component in the humidification liquid stored in the storage portion; and a remaining amount sensor configured to sense a remaining amount of the humidification liquid stored in the storage portion, wherein the indicator obtainer is configured to obtain the indicator indicating the concentration of the non-volatile component in the humidification liquid stored in the storage portion, based on the amount of the non-volatile component which is stored in the storage device and the remaining amount of the humidification liquid which has been sensed by the remaining amount sensor.

17. The liquid ejection apparatus according to claim 1, further comprising a liquid discharge mechanism configured to discharge at least a portion of the humidification liquid stored in the storage portion, to an outside of the storage portion, wherein the controller is configured to, when the concentration indicated by the indicator is greater than a preset value, control the liquid discharge mechanism to discharge at least a portion of the humidification liquid stored in the storage portion, to the outside of the storage portion.

* * * * *